US006930451B2

(12) United States Patent
Terao et al.

(10) Patent No.: US 6,930,451 B2
(45) Date of Patent: Aug. 16, 2005

(54) PLASMA DISPLAY AND MANUFACTURING METHOD THEREOF

(75) Inventors: Yoshitaka Terao, Yokohama (JP); Takashi Komatsu, Yokohama (JP); Je-Hwan Oh, Seongnam (KR); Hidehito Ogawa, Yokohama (JP); Yukika Yamada, Yokohama (JP)

(73) Assignee: Samsung SDI Co., Ltd., Suwon-si (KR)

( * ) Notice: Subject to any disclaimer, the term of this patent is extended or adjusted under 35 U.S.C. 154(b) by 129 days.

(21) Appl. No.: 10/045,017

(22) Filed: Jan. 15, 2002

(65) Prior Publication Data

US 2002/0105270 A1 Aug. 8, 2002

(30) Foreign Application Priority Data

Jan. 16, 2001 (JP) ..... 2001-007754
Jan. 16, 2001 (JP) ..... 2001-007755

(51) Int. Cl.[7] ..... H01J 17/49
(52) U.S. Cl. ..... 313/587; 313/582
(58) Field of Search ..... 313/582–587, 313/382–385

(56) References Cited

U.S. PATENT DOCUMENTS 4,423,352 A * 12/1983 Miyazaki et al. ..... 313/584
5,041,759 A * 8/1991 Kwon et al. ..... 313/495
5,384,514 A * 1/1995 Kim ..... 313/585
5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,952,782 A 9/1999 Nanto et al.
6,236,160 B1 * 5/2001 Komaki et al. ..... 313/586
6,307,318 B1 * 10/2001 Kaake et al. ..... 313/586
RE37,444 E 11/2001 Kanazawa
6,424,095 B1 * 7/2002 Hirao et al. ..... 315/169.4
6,456,007 B1 * 9/2002 Ryu et al. ..... 313/586
6,630,916 B1 10/2003 Shinoda
6,670,757 B2 * 12/2003 Kato et al. ..... 313/587
6,707,436 B2 3/2004 Setoguchi et al.

FOREIGN PATENT DOCUMENTS

| | | |
|---|---|---|
| JP | 02-148645 | 6/1990 |
| JP | 8-212918 | 8/1996 |
| JP | 2845183 | 10/1998 |
| JP | 2917279 | 4/1999 |
| JP | 2001-043804 | 2/2001 |

OTHER PUBLICATIONS

"*Final Draft International Standard*", Project No. 47C/61988–1Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

*Primary Examiner*—Joseph Williams
*Assistant Examiner*—Peter Macchiarolo
(74) *Attorney, Agent, or Firm*—Robert E. Bushnell, Esq.

(57) ABSTRACT

A plasma display includes first and second substrates provided opposing one another. A plurality of first electrodes is formed on a surface of the first substrate facing the second substrate. A first dielectric layer is formed covering the first electrodes. A plurality of main barrier ribs is formed on a surface of the second substrate facing the first substrate, the main barrier ribs defining a plurality of discharge cells. A plurality of electrode barrier ribs is formed on the second substrate between the main barrier ribs. Phosphor layers are formed within the discharge cells, and discharge gas included in the discharge cells, where the main barrier ribs are formed integrally to the second substrate, and a second electrode and a second dielectric layer are formed, in this order, on a distal end of each of the electrode barrier ribs. A method of manufacturing the plasma display includes the processes of integrally forming a plurality of main barrier ribs on a plasma display substrate, the main barrier ribs defining a plurality of discharge cells, forming electrode barrier ribs between the main barrier ribs, forming an electrode on a distal end of each of the electrode barrier ribs, and forming a dielectric layer on each of the electrodes.

22 Claims, 18 Drawing Sheets

PLASMA DISPLAY AND MANUFACTURING METHOD THEREOF

CLAIM OF PRIORITY

This application makes reference to, incorporates the same herein, and claims all benefits accruing under 35 U.S.C. § 119 from my applications: Plasma Display and Manufacturing Method Thereof filed with the Japan Patent Office on 16 Jan. 2001 and there duly assigned Serial No. 2001-7754 and Gas Discharge Display Device filed with the Japan Patent Office on 16 Jan. 2001 and there duly assigned Serial No. 2001-7755.

BACKGROUND OF THE INVENTION

1. Field of the Invention

The present invention relates to a display device, and more particularly, to a plasma display and a manufacturing method thereof.

2. Related Art

A prior art plasma display includes two glass substrates provided opposing one another (hereinafter referred to as the front substrate and the rear substrate). A plurality of electrodes are formed over an inside surface of the front substrate, and a dielectric layer, which includes a protection layer made of a compound such as MgO, is formed covering the electrodes. Further, a plurality of electrodes is formed on an inside surface of the rear substrate. The electrodes are provided perpendicular to the electrodes formed on the front substrate. In order to form discharge cells, which are spaces where gas discharge is performed, a plurality of barrier ribs are formed on the rear substrate. That is, the barrier ribs are formed to both sides of each of the electrodes and parallel to the same. Dielectric layers with a high reflexibility are formed covering the electrodes and on surfaces of the barrier ribs in each of the discharge cells. Also, R (red),G (green),B (blue) phosphor layers are formed over the dielectric layers in each of the discharge cells.

The substrates structured as in the above are sealed in a state where a discharge gas such as Ne or He is provided in the discharge cells. A voltage is selectively provided to terminals connected to the electrodes protruding from the sealed substrates, thereby generating a discharge between the electrodes in the discharge cells. As a result of the discharge, excitation light emitted from the phosphor layers is displayed externally.

The following gives an example of how the rear substrate in such a plasma display may be manufactured.

First, a plurality of electrodes are patterned and formed by printing, etc., then sintered and secured on an original substrate glass. Next, a dielectric layer having a high reflexibility is deposited and sintered on the original substrate on which the electrodes are formed. A barrier rib material is then deposited on the original substrate glass to cover the electrodes and the dielectric layer. Next, after patterning using a photoresist such as a dry film resist (DFR), the barrier rib material except where the photoresist is formed is removed by, for example, a sand blast process.

That is, glass beads having a particle diameter of approximately 20–30 $\mu$m (micrometers) or an abrasive such as calcium carbonate is sprayed through a nozzle to remove portions of the barrier rib material not covered by the patterned photoresist. Accordingly, the lattice wall material under the photoresist pattern is left remaining to form barrier ribs. Although portions of the dielectric layer come to be exposed during the sand blast process, since the dielectric layer is hardened by sintering such that it is made harder than the barrier rib material, removal by the sand blast process stops at the surface of the dielectric layer. Next, sintering is performed to complete the fabrication of the barrier ribs and thereby form discharge cells.

Following the above processes, phosphor pixels are formed using a screen-printing process in each of the discharge cells, which are separated by the barrier ribs. The screen-printing process is a process by which a paste mixed with phosphor material is provided in the discharge cells, then dried using printing techniques performed by interposing a screen.

The barrier rib is a material that minimizes by as much as possible the amount of organic material used as a binder for maintaining the shape of the barrier ribs following drying such that removal by sand blasting is easy. The dielectric layer is made difficult to remove by sand blasting as a result of the sintering the dielectric layer as described above. However, with the application of heat to glass (original substrate glass in this case) during sintering, the glass undergoes deformation (e.g., contracts). Accordingly, it is preferable to reduce the sintering temperature or reduce the number of sintering operations to avoid such deformation.

Japanese Laid-Open Patent No. Heisei 8-212918 for Manufacture of Plasma Display Panel by Hiroyuki et al. discloses a method in which another substrate glass is directly etched to form barrier ribs. With this method, a sintering process need not be performed to form the barrier ribs as in the method described above, thereby avoiding the problem of glass deformation.

With this method, electrodes and dielectric layers provided between the barrier ribs are formed using the conventional screen-printing process after each lattice wall is formed. However, since a height of the barrier ribs is 150 $\mu$m (micrometers) or more, it becomes an involved process to provide the materials to the bottom of and between the barrier ribs, thereby making application of the screen-printing process difficult.

SUMMARY OF THE INVENTION

It is therefore an object of the present invention to provide a plasma display and a manufacturing method thereof, in which a sintering process to form barrier ribs is not needed, and a screen-printing process may be applied to form electrodes and dielectric layers.

It is another object to provide a plasma display that has fewer steps in manufacturing the plasma display.

It is still another object to provide a plasma display that is easier and less expensive to manufacture and yet maintain or exceed the quality of the plasma display.

It is yet another object to provide a method of manufacturing a plasma display that can avoid the need to provide materials for electrodes and dielectric layers to the innermost portions between the main barrier ribs.

To achieve the above and other objects, the present invention provides a plasma display and a manufacturing method of the plasma display. The plasma display includes first and second substrates provided opposing one another; a plurality of first electrodes formed on a surface of the first substrate facing the second substrate; a first dielectric layer formed covering the first electrodes; a plurality of main barrier ribs formed on a surface of the second substrate facing the first substrate, the main barrier ribs defining a plurality of discharge cells; a plurality of electrode barrier ribs formed on the second substrate between the main barrier ribs; phosphor layers formed within the discharge cells; and discharge gas provided in the discharge cells, where the main barrier ribs are formed integrally to the second substrate, and a second electrode and a second dielectric layer are formed, in this order, on a distal end of each of the electrode barrier ribs.

According to a feature of the present invention, a third dielectric layer is formed on a distal end of each main lattice wall, and a height of an upper surface of the third dielectric layer and a height of an upper surface of the second dielectric layer are substantially the same.

According to another feature of the present invention, a third dielectric layer is formed on a distal end of each main lattice wall, and a height of an upper surface of the third dielectric layer is greater than a height of an upper surface of the second dielectric layer.

According to yet another feature of the present invention, one of the second electrodes is formed on a distal end of each of the main barrier ribs and the electrode barrier ribs.

According to still yet another feature of the present invention, one of the second electrodes is formed on a distal end of each of the electrode barrier ribs.

According to still yet another feature of the present invention, the electrode barrier ribs are formed integrally to the second substrate.

According to still yet another feature of the present invention, each discharge cell is divided into a plurality of partitioned discharge cells in which the same phosphor layer formed.

According to still yet another feature of the present invention, each discharge cell is divided into two partitioned discharge cells.

According to still yet another feature of the present invention, the partitioned discharge cells have concave surfaces, and a width and depth of each of the partitioned discharge cells are formed to correspond to a color displayed by the particular partitioned discharge cell.

According to still yet another feature of the present invention, the partitioned discharge cells displaying blue have a larger width than the partitioned discharge cells displaying green, and the partitioned discharge cells displaying green have a larger width than the partitioned discharge cells displaying red.

The method includes the processes of integrally forming a plurality of main barrier ribs on a plasma display substrate, the main barrier ribs defining a plurality of discharge cells; forming electrode barrier ribs between the main barrier ribs; forming an electrode on a distal end of each of the electrode barrier ribs; and forming a dielectric layer on each of the electrodes.

According to a feature of the present invention, the main barrier ribs and the electrode barrier ribs are formed simultaneously.

According to another feature of the present invention, the main barrier ribs, the electrode barrier ribs, and the electrodes are formed simultaneously.

According to yet another feature of the present invention, the main barrier ribs, the electrode barrier ribs, the electrodes, and the dielectric layers are formed simultaneously.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 41 is an alternative to the seventh preferred embodiment of the present invention with an enlarged sectional view of area F of FIG. 30; and.

DETAILED DESCRIPTION OF THE PREFERRED EMBODIMENTS

Figure 40:
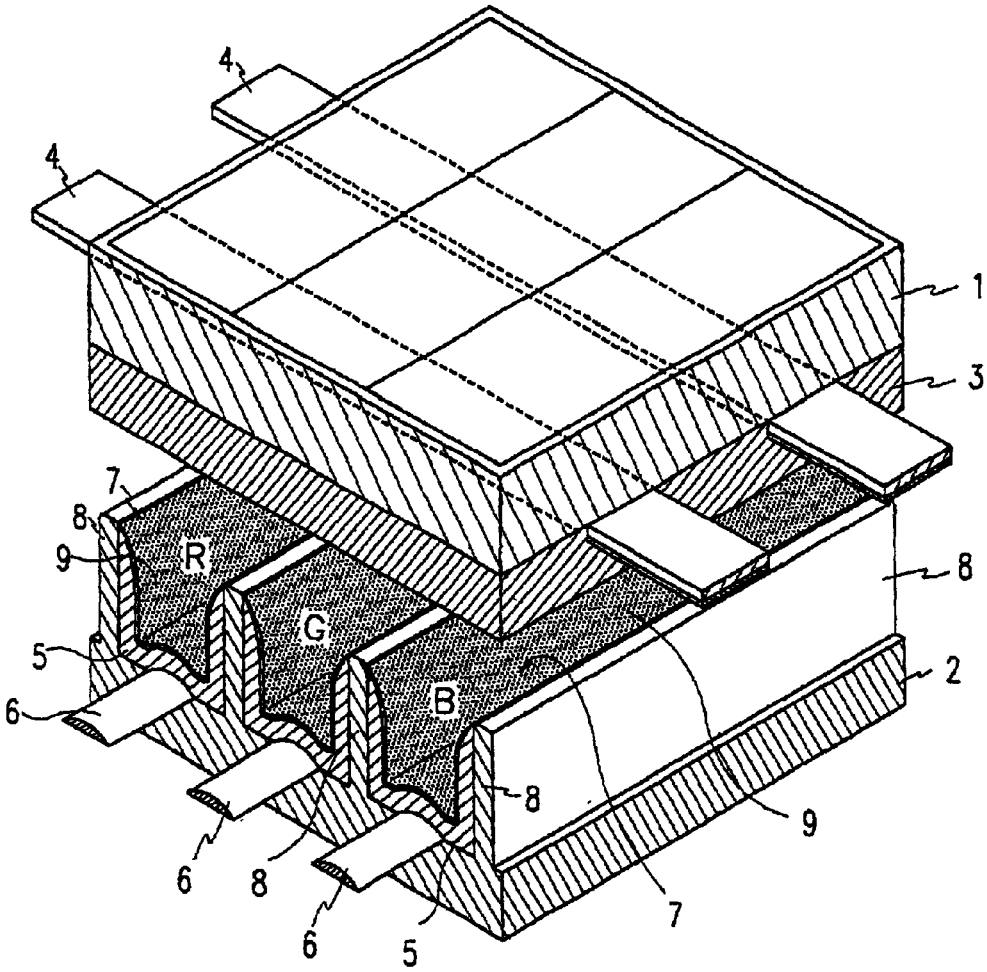
Fig. 40 (Prior Art)
FIG. 40 is a partial exploded perspective view of a conventional plasma display.

Turning now to the drawings, a prior art plasma display, with reference to FIG. 40, includes two glass substrates 1 and 2 provided opposing one another (hereinafter referred to as the front substrate 1 and the rear substrate 2). A plurality of electrodes 4 are formed over an inside surface of the front substrate 1, and a dielectric layer 3, which includes a protection layer made of a compound such as MgO, is formed covering the electrodes 4. Further, a plurality of electrodes 6 is formed on an inside surface of the rear substrate 2. The electrodes 6 are provided perpendicular to the electrodes 4 formed on the front substrate 1. In order to form discharge cells 7, which are spaces where gas discharge is performed, a plurality of barrier ribs 8 are formed on the rear substrate 2. That is, the barrier ribs 8 are formed to both sides of each of the electrodes 6 and parallel to the same. Dielectric layers 5 with a high reflexibility are formed covering the electrodes 6 and on surfaces of the barrier ribs 8 in each of the discharge cells 7. Also, R (red),G (green),B (blue) phosphor layers 9 are formed over the dielectric layers 5 in each of the discharge cells 7.

The substrates 1 and 2 structured as in the above are sealed in a state where a discharge gas such as Ne or He is provided in the discharge cells 7. A voltage is selectively provided to terminals connected to the electrodes 4 and 6 protruding from the sealed substrates 1 and 2, thereby generating a discharge between the electrodes 4 and 6 in the discharge cells 7. As a result of the discharge, excitation light emitted from the phosphor layers 9 is displayed externally.

The following gives an example of how the rear substrate 2 in such a plasma display may be manufactured.

First, a plurality of electrodes 6 are patterned and formed by printing, etc., then sintered and fixed on an original substrate glass. Next, a dielectric layer 5 having a high reflexibility is deposited and sintered on the original substrate on which the electrodes 6 are formed. A barrier rib material is then deposited on the original substrate glass to cover the electrodes 6 and the dielectric layer 5. Next, after patterning using a photoresist such as a dry film resist (DFR), the barrier rib material except where the photoresist is formed is removed by, for example, a sand blast process.

That is, glass beads having a particle diameter of approximately 20–30 $\mu$m or an abrasive such as calcium carbonate is sprayed through a nozzle to remove portions of the barrier rib material not covered by the patterned photoresist. Accordingly, the lattice wall material under the photoresist pattern is left remaining to form barrier ribs 8. Although portions of the dielectric layer 5 come to be exposed during the sand blast process, since the dielectric layer 5 is hardened by sintering such that it is made harder than the barrier rib material, removal by the sand blast process stops at the surface of the dielectric layer 5. Next, sintering is performed to complete the fabrication of the barrier ribs 8 and thereby form discharge cells 7.

Following the above processes, phosphor pixels are formed using a screen-printing process in each of the discharge cells 7, which are separated by the barrier ribs 8. The screen-printing process is a process by which a paste mixed with phosphor material is provided in the discharge cells 7, then dried using printing techniques performed by interposing a screen.

The barrier rib is a material that minimizes by as much as possible the amount of organic material used as a binder for maintaining the shape of the barrier ribs 8 following drying such that removal by sand blasting is easy. The dielectric layer 5 is made difficult to remove by sand blasting as a result of the sintering the dielectric layer 5 as described above. However, with the application of heat to glass (original substrate glass in this case) during sintering, the glass undergoes deformation (e.g., contracts). Accordingly, it is preferable to reduce the sintering temperature or reduce the number of sintering operations to avoid such deformation.

Figure 1:
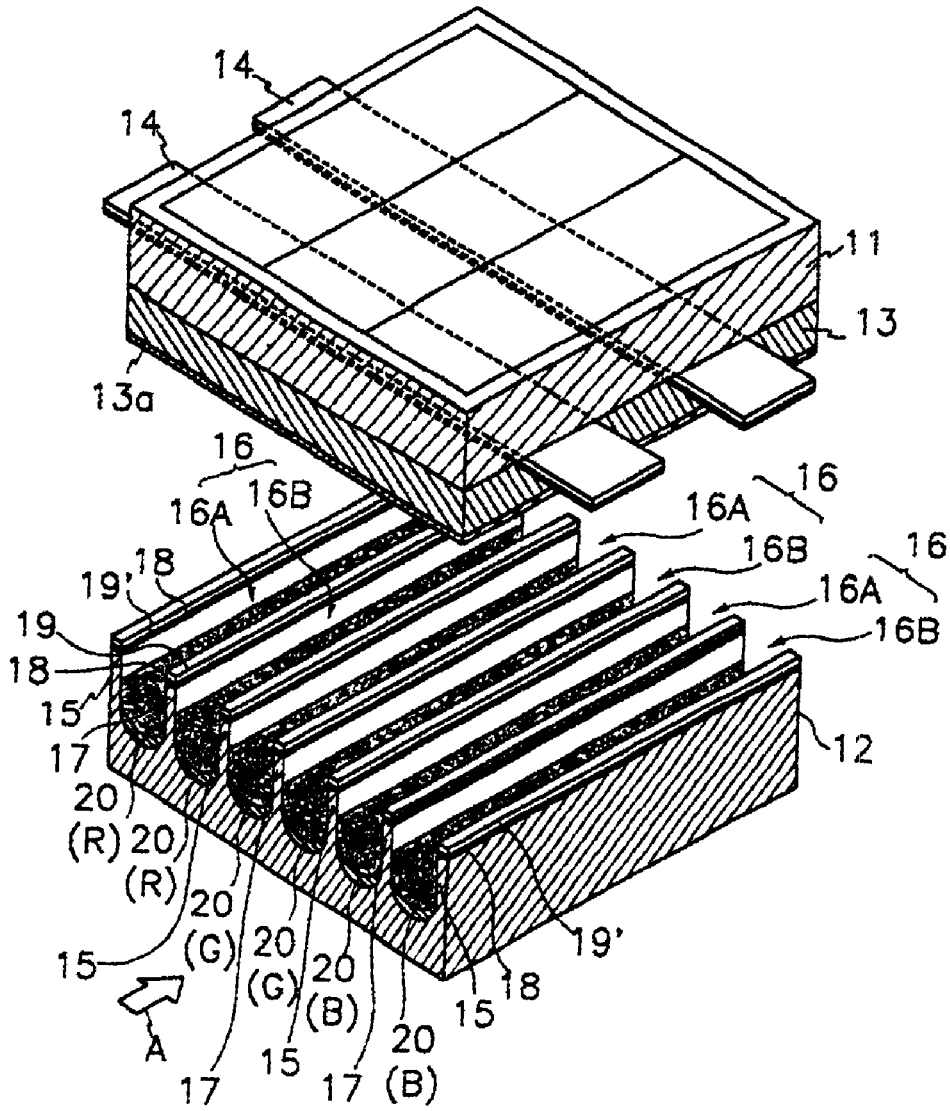
FIG. 1 is a partial exploded perspective view of a plasma display according to a first preferred embodiment of the present invention.
Figure 2:
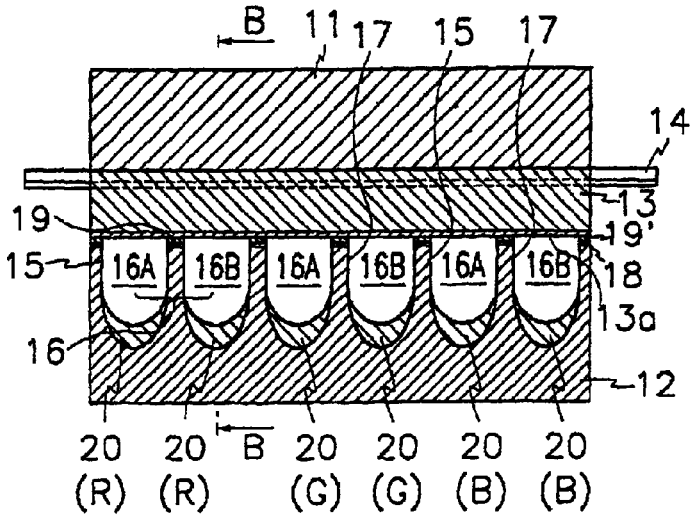
FIG. 2 is a sectional view of the plasma display of FIG. 1, in which the plasma display is assembled and the view is taken in the direction shown by arrow A of FIG. 1.
Figure 3:
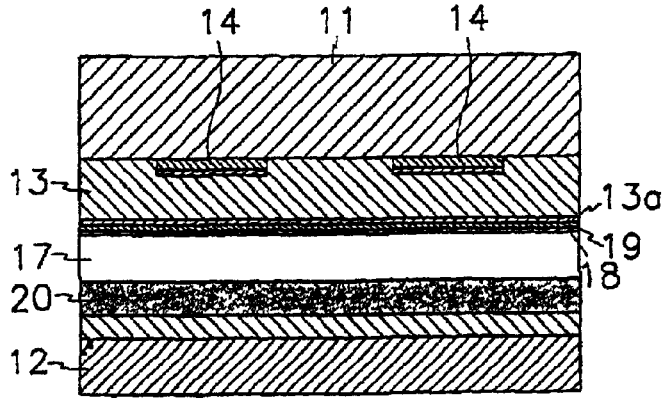
FIG. 3 is a sectional view taken along line B—B of FIG. 2.

FIG. 1 is a partial exploded perspective view of a plasma display according to a first preferred embodiment of the present invention, FIG. 2 is a sectional view of the plasma display of FIG. 1, in which the plasma display is assembled and the view is taken in the direction shown by arrow A of FIG. 1, FIG. 3 is a sectional view taken along line B—B of FIG. 2, and FIGS. 4 through 9 are views shown from the direction of arrow A of FIG. 1 used to describe processes in the manufacture of the plasma display of FIG. 1.

A plasma display according to a first preferred embodiment of the present invention, with reference to FIGS. 1 through 3, includes two glass substrates 11 and 12 provided opposing one another (hereinafter referred to as the first substrate 11 and the second substrate 12). A plurality of first electrodes 14 are formed on an inside surface of the first substrate 11, and a first dielectric layer 13, which includes a protection layer 13*a* made of a compound such as MgO, is formed covering the first electrodes 14.

With respect to the second substrate 12, a plurality of main barrier ribs (also called main lattice walls) 15 are integrally formed on the second substrate 12 protruding from a surface of the same that opposes the first substrate 11. A plurality of discharge cells 16 are defined by the formation of the main barrier ribs 15, and a plurality of electrode barrier ribs (also called electrode lattice walls) 17 are formed between the main barrier ribs 15 and in the same manner as the main barrier ribs 15. Mounted on a distal end of each of the electrode barrier ribs 17 are a second electrode 18 and a second dielectric layer 19, and a second electrode 18 and a third dielectric layer 19' may be mounted on a distal end of each of the main barrier ribs 15.

With the above structure, the main barrier ribs 15, the discharge cells 16, the electrode barrier ribs 17, the second electrodes 18, and the second and third dielectric layers 19 and 19' are all formed in the same direction, that is, in parallel. The first electrodes 14 of the first substrate 11 are formed perpendicular to the elements of the second substrate 12. Further, the electrode barrier ribs 17 are provided at substantially a center between a pair of main barrier ribs 15 (i.e., a center of a width of the discharge cells 16). The dielectric layers 19 and 19' formed on the electrode barrier ribs 17 and the main barrier ribs 15, respectively, cover the second electrodes 18 formed on the distal ends of the barrier ribs 17 and 15.

In the preferred embodiment of the present invention, each of the main barrier ribs 15 and the electrode barrier ribs 17 are formed at a substantially identical height, each of the second electrodes 18 formed on the main barrier ribs 15 is formed at a substantially identical thickness to each of the second electrodes 18 formed on the electrode barrier ribs 17, and each of the third dielectric layers 19' form on the main barrier ribs 15 is formed at a substantially identical thickness to each of the second dielectric layers 19 formed on the electrode barrier ribs 17. Accordingly, a height of an upper surface of the third dielectric layers 19' is substantially the same as a height of an upper surface of the second dielectric layers 19.

Among the second electrodes 18, the second electrodes 18 formed on the electrode barrier ribs 17 realize an electrical connection with the first electrodes 14 formed on the first substrate 11 in order to perform discharge in areas between these second electrodes 18 and the first electrodes 14. The second electrodes 18 formed on the main barrier ribs 15, on the other hand, are used to ensure that a height of the third dielectric layers 19' of the main barrier ribs 15 is substantially the same as a height of the second dielectric layers 19 of the electrode barrier ribs 17 such that no gaps form between an upper end of the main barrier ribs 15 and the protection layer 13*a* of the first dielectric layer 13 of the first substrate 11 when the second substrate 12 is assembled to the first substrate 11.

Each electrode lattice wall 17 divides each discharge cell 16 formed between the main barrier ribs 15 into a plurality of partitioned discharge cells. In the present invention, each discharge cell 16 is divided equally into two partitioned discharge cells 16A and 16B. The partitioned discharge cells 16A and 16B are used as spaces in which gas discharge is performed. R, G, B (red, green, blue) phosphor layers 20 are formed on a bottom surface of the partitioned discharge cells 16A and 16B.

Either a red, green, or blue phosphor layer 20 is formed in one discharge cell 16. However, with the formation of the electrode barrier ribs 17 between the main barrier ribs 15, the phosphor layers 20 formed in each pair of the partitioned discharge cells 16A and 16B are of the same color.

After the first and second substrates 11 and 12 structured as in the above are provided one placed on top of the other, the first and second substrates 11 and 12 are sealed in a state where a discharge gas such as Ne or He is provided in the discharge cells 16. A voltage is selectively provided to terminals connected to the first and second electrodes 14 and 18 protruding from the sealed substrates 11 and 12, thereby generating discharge between the first and second electrodes 14 and 18 in the discharge cells 16. As a result of the discharge, excitation light emitted from the phosphor layers 20 in the discharge cells 16 (i.e., the partitioned discharge cells 16A and 16B) is displayed externally.

However, since only the second electrodes 18 formed on the electrode barrier ribs 17 realize an electrical connection with the first electrodes 14 of the first substrate 11 in order to perform discharge as described above, the second electrodes 18 of the main barrier ribs 15 are not electrically connected and act as float electrodes, or they may be grounded so that they do not affect the discharge operation.

The second substrate 12 of the plasma display structured as in the above is manufactured roughly as described below. That is, manufacture of the second substrate 12 includes a main lattice wall formation process, in which an original substrate glass is cut and the main barrier ribs 15 are formed integrally to the cut glass; an electrode lattice wall formation process, in which the electrode barrier ribs 17 are formed integrally to the original substrate glass between the main barrier ribs 15; an electrode formation process, in which the second electrodes 18 are formed on the distal ends of the main barrier ribs 15 and the electrode barrier ribs 17; a dielectric layer formation process, in which the second and third dielectric layers 19 and 19' are formed on the second electrodes 18 formed on the main barrier ribs 15 and the electrode barrier ribs 17, respectively; and a phosphor layer formation process, in which the phosphor layers 20 are formed in each discharge cell 16, that is, each of the partitioned discharge cells 16A and 16B.

The main lattice wall formation process and the electrode lattice wall formation process are performed simultaneously. Accordingly, the two processes will be referred to as simply the lattice wall formation process hereinafter.

Each of the manufacturing processes of the second substrate 12 will be described in more detail. First, in the lattice wall formation process, after washing then drying the original substrate glass, a sheet-type photoresist such as a dry film resist (DFR), which is resistant to sandblasting, is applied to an upper surface of the original substrate glass (results of this process not shown).

Figure 4:
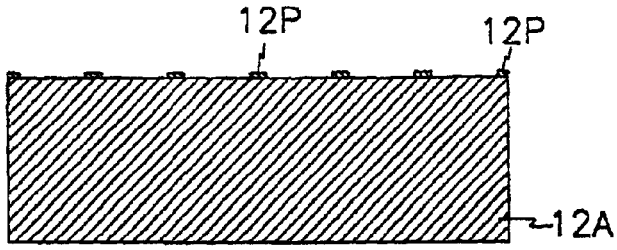
FIGS. 4 through 6, 8, and 9 are sectional views used to describe processes in the manufacture of a plasma display according to a first preferred embodiment of the present invention.

Next, with reference to FIG. 4, the photoresist is exposed and developed using a mask such that photoresists 12P are formed in a predetermined pattern that correspond to locations and an upper-surface shape of the main barrier ribs 15 and the electrode barrier ribs 17. Reference numeral 12A indicates the original substrate glass.

Figure 5:
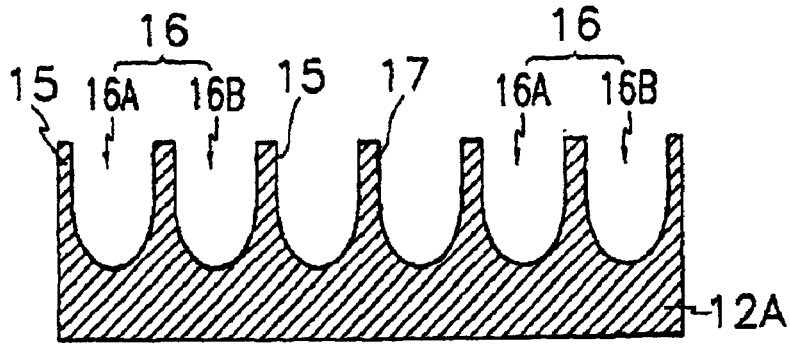

Subsequently, with reference to FIG. 5, areas where the photoresists 12P of the original substrate glass 12A are not formed are removed to a predetermined depth and shape using a sandblast process such that the main barrier ribs 15 and the electrode barrier ribs 17 are formed. In the drawing, the photoresists 12P have been peeled away following this process.

As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17.

With respect to the sandblast process, since materials such as calcium carbonate or glass beads do not provide sufficient cutting strength to the original substrate glass 12A, which is made of a material such as soda lime glass, the desired removal of portions of the original substrate glass 12A may not be achieved. Accordingly, it is preferable that stronger materials such as silundum powder or alumina be used for the sandblast process.

In this case, it is preferable that a DFR (dry film resist) be selected according to its adhesive strength to the original substrate glass 12A and resistance to sandblasting (for example, BF403 produced by Tokyo Ohka Kogyo Co., Ltd.).

Further, in the lattice wall formation process, a process is described in which the main barrier ribs 15 and the electrode barrier ribs 17 are formed integrally in the original substrate glass 12A using a sandblasting process. However, the present invention is not limited to this method of lattice wall formation and it is possible to form the barrier ribs using other processes such as a chemical etching process.

Next, the electrode formation process, dielectric layer formation process, and phosphor layer formation process are performed in this sequence. In more detail, in the electrode formation process, a silver paste (for example, XFP-5369-50L produced by Namics Co.) is deposited on distal ends of the main barrier ribs 15 and the electrode barrier ribs 17 using a screen-printing process. At this time, it is possible to deposit the silver paste only on the upper surfaces of the main and electrode barrier ribs 15 and 17, or to deposit the silver paste such that it is deposited down both sides of the upper surfaces of the main and electrode barrier ribs 15 and 17 for a predetermined distance.

Figure 6:
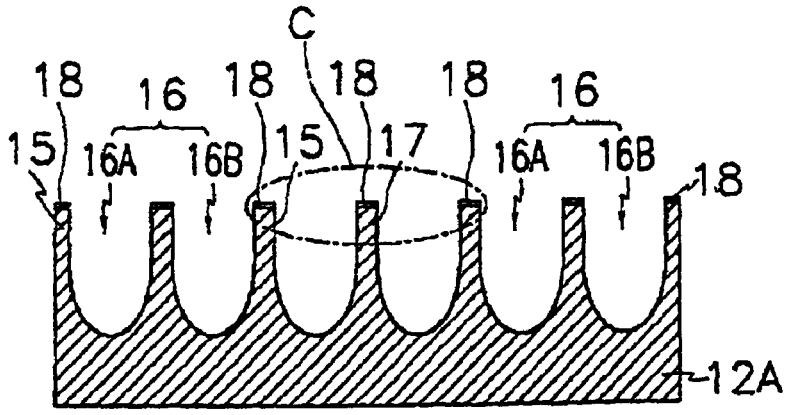
Figure 7:
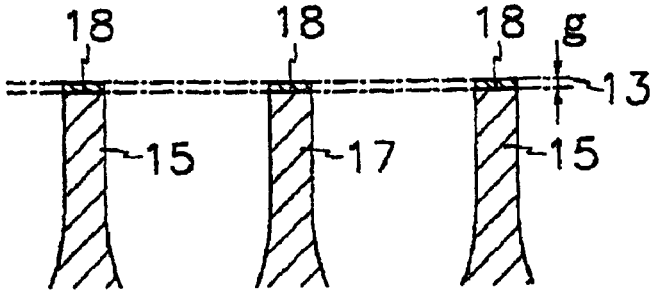
FIG. 7 is an enlarged sectional view of area C of FIG. 6.

Subsequently, the original substrate glass 12A with the silver paste applied thereon is dried for approximately ten minutes at a temperature of roughly 150° C. (degrees Celsius) then sintered for approximately 10 minutes at a temperature of roughly 550° C. (degrees Celsius), such that the formation of the second electrodes 18 is completed as shown in FIG. 6. As described above, the second electrodes 18 are formed on the main barrier ribs 15 so that the main barrier ribs 15 are the same height as the electrode barrier ribs 17, that is, so that a gap (g) as shown in FIG. 7 is not formed with the first dielectric layer 13 of the first substrate 11. Accordingly, the second electrodes 18 formed on the main barrier ribs 15 act as float electrodes in that no electrical connection is made with these second electrodes 18. Alternatively, the second electrodes 18 formed on the main barrier ribs 15 may be grounded to ensure that these second electrodes 18 do not affect the gas discharge process. It is preferable that the thickness of the second electrodes 18 is approximately 5 $\mu$m.

Next, in the dielectric layer formation process, a dielectric paste (for example, GLP-86087 produced by Sumitomo Metal Mining Co., Ltd.) is deposited to cover the second electrodes 18 using a screen-printing process. At this time, it is possible to deposit the dielectric paste only so that upper surfaces of the second electrodes 18 are covered, or to deposit the dielectric paste such that it is deposited also down both sides of the upper surfaces of the second electrodes 18 for a predetermined distance, or to deposit the dielectric paste such that it continues down both sides of the main and electrode barrier ribs 15 and 17 for a predetermined distance.

Figure 8:
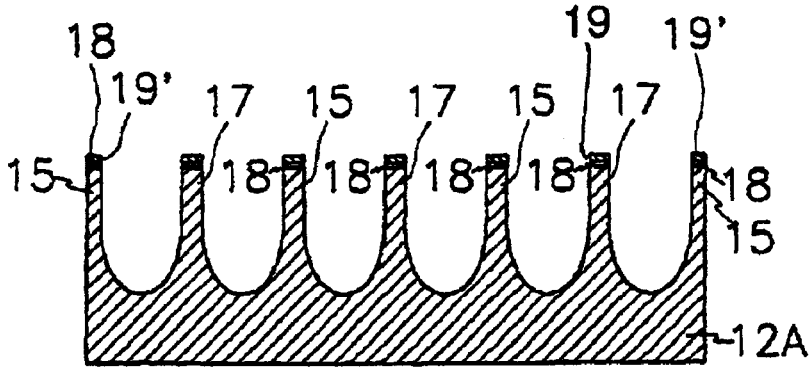

Subsequently, the original substrate glass 12A with the dielectric paste applied thereon is dried for approximately ten minutes at a temperature of roughly 150° C. (degrees Celsius) then sintered for approximately 10 minutes at a temperature of roughly 550° C. (degrees Celsius) such that the formation of the second and third dielectric layers 19 and 19' is completed as shown in FIG. 8. It is preferable that a thickness of the second and third dielectric layers 19 and 19' is approximately 10 $\mu$m.

Next, in the phosphor layer formation process, with reference to FIG. 1, three types of phosphor paste (red, green, and blue phosphor paste) are selectively printed on an innermost portion of each discharge cell 16, that is, an innermost portion of each partitioned discharge cell 16A and 16B. At this time, the phosphor paste is deposited such that the same color of phosphor paste is provided in pairs of the partitioned discharge cells 16A and 16B divided by one of the electrode barrier ribs 17.

Figure 9:
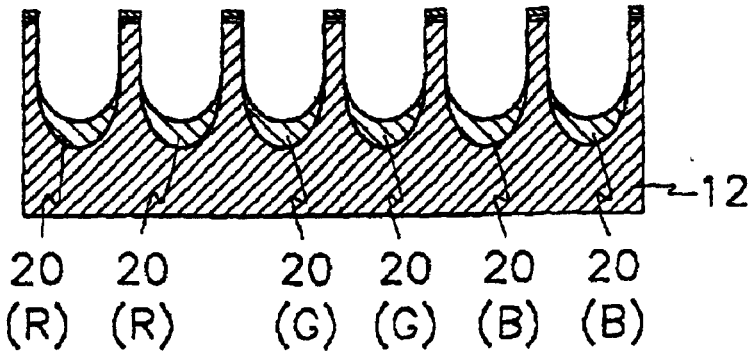

As a phosphor powder used to make the phosphor paste, a green phosphor material (for example, P1G1 produced by Kasei Optonix, Ltd.), a red phosphor material (for example, KX504A made by the same company), and a blue phosphor material (for example, KX501 A made by the same company) are mixed in suitable quantities to a screen-printing vehicle (for example, the screen-printing vehicle produced by Okuno Chemical Industries Co., Ltd.). The phosphor paste is formed in a predetermined pattern using a screen-printing process. Subsequently, the original substrate glass 12A with the phosphor paste applied thereon is dried for approximately ten minutes at a temperature of roughly 150° C. (degrees Celsius) then sintered for approximately 10 minutes at a temperature of roughly 450° C. (degrees Celsius) such that the formation of the phosphor layers 20 is completed as shown in FIG. 9.

After the above processes, the second substrate 12 manufactured as described above is placed in close contact with the completed first substrate 11, and the first and second substrates 11 and 12 are sealed using sealant glass (not shown) where the first and second substrates 11 and 12 meet and in a state where discharge gas such as Ne or He is provided in the discharge cells 16. Connections are made with the terminals (not shown) of the first and second electrodes 14 and 18 to allow the application of a voltage thereto. Accordingly, the plasma display is completed.

In the plasma display according to the first preferred embodiment of the present invention, with respect to the second substrate 12, each main lattice wall 15 is formed integrally to the original substrate glass 12A, the electrode barrier ribs 17 are formed integrally to the original substrate glass 12A between each of the main barrier ribs 15, and the second electrodes 18 and the second dielectric layers 19 are formed on the upper end of the electrode barrier ribs 17.

Further, the manufacturing process of the second substrate 12 includes the lattice wall formation process, in which the main barrier ribs 15 are formed integrally to the original substrate glass 12A; the electrode lattice wall formation process, in which the electrode barrier ribs 17 are formed integrally to the original substrate glass 12A between the main barrier ribs 15; the electrode formation process, in which the second electrodes 18 are formed on the distal ends of the electrode barrier ribs 17; and the dielectric layer formation process, in which the second dielectric layers 19 are formed on the upper surface of the second electrodes 18.

Accordingly, in the plasma display and method for manufacturing the same according to the preferred embodiment of the present invention, since the main barrier ribs and the electrode barrier ribs 17 are formed integrally to the original substrate glass 12A by cutting the original substrate glass 12A, it is not necessary to perform sintering to harden the barrier ribs 15 and 17 as in the prior art. That is, it is unnecessary to perform hardening as in the prior art method, in which the barrier ribs are formed by depositing a lattice wall material rather than selectively removing the material.

Also, the second electrodes 18 and the second dielectric layers 19 of the first preferred embodiment of the present invention are not formed at an innermost portion between the barrier ribs 15 and 17 as in the prior art, and instead are formed at the uppermost end of the electrode barrier ribs 17. As a result, when forming the second electrodes 18 and the second dielectric layers 19 using the screen-printing process, the difficult process of providing the materials used for these elements to the innermost portions between the main barrier ribs 15 as in the prior art is not required.

Accordingly, in the first preferred embodiment of the present invention, a sintering process is not needed in the formation of the main barrier ribs 15, and further, a screen-printing process may be applied in the formation of the second electrodes 18 and the second dielectric layer 19.

In addition, with respect to the second substrate 12 in the plasma display according to the first preferred embodiment of the present invention, by forming the second electrodes 18 of the same thickness on both the main barrier ribs 15 and the electrode barrier ribs 17, and the second and third dielectric layers 19 and 19' of the same thickness on the second electrodes 18 of both barrier ribs 17 and 15, respectively, the uppermost surface of the dielectric layers 19' of the main barrier ribs 15 are at the same height as the uppermost surface of the dielectric layers 19 of the electrode barrier ribs 17. With this configuration, no gaps are formed when the first substrate 1 is assembled to the second substrate 12 such that the discharge cells 16 and the partitioned discharge cells 16A and 16B are completely sealed.

In the manufacturing method of the plasma display according to the first preferred embodiment of the present invention, the main lattice wall formation process and the electrode lattice wall formation process are performed simultaneously. By the simultaneous formation and by using the processes to form both types of the barrier ribs 15 and 17, the overall number of processes is reduced to thereby minimize manufacturing costs. Also, this allows the height of the main barrier ribs 15 to be easily and precisely made the same as the height of the electrode barrier ribs 17.

In the manufacturing method according to the first preferred embodiment of the present invention, although the processes are performed in the sequence of the lattice wall formation process, the electrode formation process, the dielectric layer formation process, and the phosphor layer formation process, the present invention is not limited to such a sequence of processes. It is possible to perform the dielectric layer formation process following the electrode formation process, the phosphor layer formation process following the lattice wall formation process.

Manufacturing methods according to second, third, and fourth preferred embodiments of the present invention will now be described.

Figure 10:
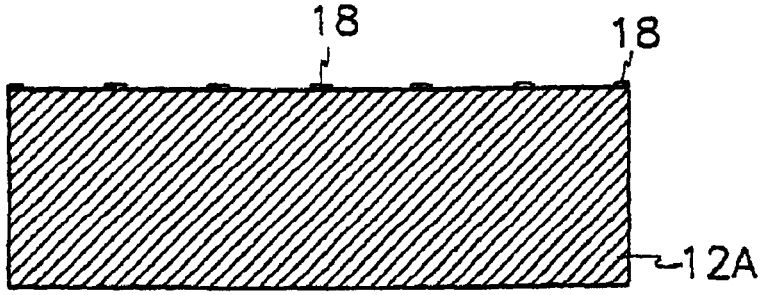
FIGS. 10 through 12 are sectional views used to describe processes in the manufacture of a plasma display according to a second preferred embodiment of the present invention.
Figure 11:
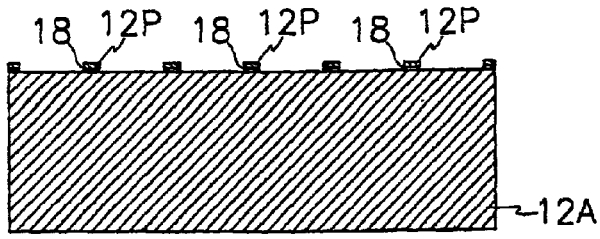

A second preferred embodiment of the present invention will be described with reference to FIGS. 10 through 12.

In the manufacturing method according to the first preferred embodiment of the present invention, the processes for manufacturing the second substrate 12 are performed in the sequence of the lattice wall formation process, the electrode formation process, the dielectric layer formation process, and the phosphor layer formation process. However, in the second preferred embodiment of the present invention, the processes for manufacturing the second substrate 12 are performed in the sequence of the electrode formation process, the lattice wall formation process, the dielectric layer formation process, and the phosphor layer formation process.

In the second preferred embodiment of the present invention, the dielectric layer formation process, the phosphor layer formation process, and the processes for completing the plasma display after manufacture of the second substrate 12 are identical to those in the first preferred embodiment of the present invention such that a detailed description will not be provided. Further, the same reference numerals will be used for elements identical to those of the first preferred embodiment and a detailed description of these elements will not be provided.

First, in the electrode formation process, after washing then drying the original substrate glass 12A, a silver paste is deposited on locations corresponding to where the main barrier ribs 15 and the electrode barrier ribs 17 will be formed, and over an area corresponding to the uppermost shape of these elements (i.e., corresponding to the locations and shape of the second electrodes 18). Next, the original substrate glass 12A with the silver paste applied thereon is dried for approximately ten minutes at a temperature of roughly 150° C. (degrees Celsius) then sintered for approximately 10 minutes at a temperature of roughly 550° C. (degrees Celsius) such that the formation of the second electrodes 18 corresponding to the position and shape of the barrier ribs 15 and 17 is completed as shown in FIG. 10.

Next, in the lattice wall formation process, a sheet-type photoresist such as a DFR, which is resistant to sandblasting, is applied to the upper surface of the original substrate glass 12A on which the second electrodes 18 are formed. The photoresist is then exposed and developed using a mask such that photoresists 12P are formed in a predetermined pattern as shown in FIG. 11, in which the predetermined pattern corresponds to locations and the shape of the main barrier ribs 15 and the electrode barrier ribs 17, that is, to the locations and shape of the second electrodes 18.

Figure 12:
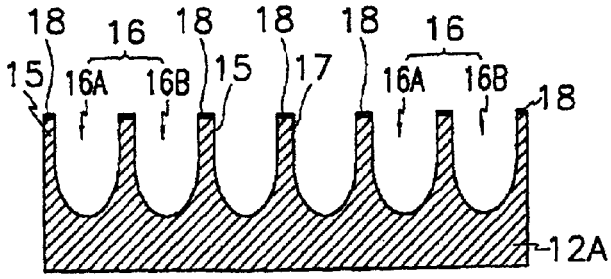

Subsequently, with reference to FIG. 12, areas where the photoresists 12P of the original substrate glass 12A are not formed are removed to a predetermined depth and shape using a sandblast process such that the main barrier ribs 15 and the electrode barrier ribs 17 are formed. In the drawing, the photoresists 12P have been peeled away following this process.

As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17.

Next, the second and third dielectric layers 19 and 19' and the phosphor layers 20 are formed as in the first preferred embodiment of the present invention to complete the manufacture of the second substrate 12, after which the remaining processes for manufacturing the plasma display are performed identically as in the first preferred embodiment of the present invention.

Accordingly, in the second preferred embodiment of the present invention, the processes for manufacturing the second substrate 12 may be performed in the sequence of the electrode formation process, the lattice wall formation process, the dielectric layer formation process, and the phosphor layer formation process to manufacture a plasma display that is identical to that of the first preferred embodiment of the present invention. Also, the same advantages obtained through the manufacturing process according to the first preferred embodiment of the present invention may be obtained by the manufacturing process according to the second preferred embodiment of the present invention.

In more detail, according to the manufacturing process of the second preferred embodiment of the present invention, it is not necessary to perform sintering to harden the barrier ribs 15 and 17 as in the prior art. That is, it is unnecessary to perform hardening as in the prior art method, in which the barrier ribs are formed by depositing a lattice wall material then selectively removing the material. Further, a screen-printing process may be applied in the formation of the second electrodes 18 and the second and third dielectric layers 19 and 19'.

A third preferred embodiment of the present invention will be described with reference to FIGS. 13 through 15.

The manufacturing method according to the third preferred embodiment of the present invention is almost identical to that of the second preferred embodiment of the present invention. However, in the third preferred embodiment, the processes of sintering the silver paste and removing the photoresists 12P after performing selective removal of the original substrate glass 12A by sandblasting are performed in a single process.

In the third preferred embodiment of the present invention, the dielectric layer formation process, the phosphor layer formation process, and the processes for completing the plasma display after manufacture of the second substrate 12 are identical to those in the first preferred embodiment of the present invention such that a detailed description will not be provided. Further, the same reference numerals will be used for elements identical to those of the first preferred embodiment and a detailed description of these elements will not be provided.

Figure 13:
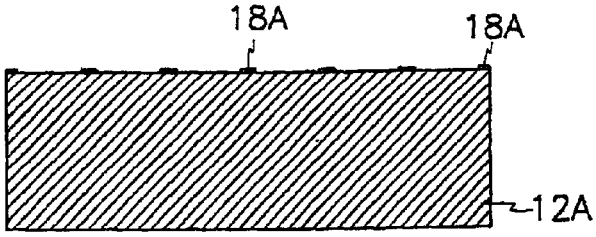
FIGS. 13 through 15 are sectional views used to describe processes in the manufacture of a plasma display according to a third preferred embodiment of the present invention.

First, in the electrode formation process, after washing then drying the original substrate glass 12A, a silver paste 18A is deposited on locations corresponding to where the main barrier ribs 15 and the electrode barrier ribs 17 will be formed, and over an area corresponding to the uppermost shape of these elements (i.e., corresponding to positions and the shape of the second electrode 18) as shown in FIG. 13. Next, the original substrate glass 12A with the silver paste 18A applied thereon is dried for approximately ten minutes at a temperature of roughly 150° C. (degrees Celsius). Sintering of the silver paste 18A is not performed.

Figure 14:
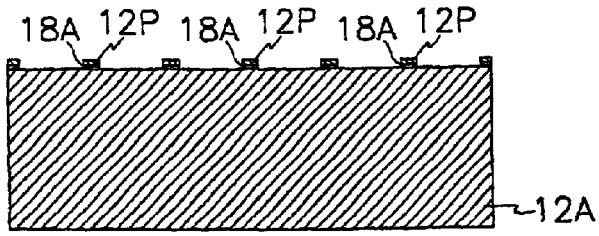
Figure 15:
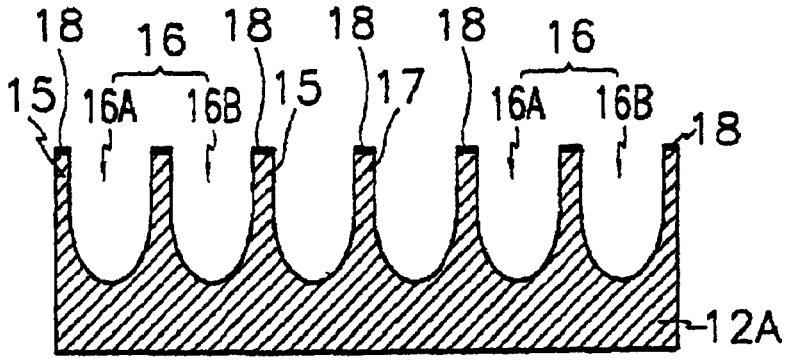

Next, in the lattice wall formation process, a photoresist that is resistant to sandblasting is applied to the upper surface of the original substrate glass 12A on which silver paste 18A is deposited, and the photoresist is then exposed and developed using a mask such that photoresists 12P are formed in a predetermined pattern as shown in FIG. 14, in which the predetermined pattern corresponds to locations and the shape of the main barrier ribs 15 and the electrode barrier ribs 17, that is, to the locations and shape of the silver paste 18A. Subsequently, areas where the photoresists 12P of the original substrate glass 12A are not formed are removed to a predetermined depth and shape using a sandblast process such that the main barrier ribs 15 and the electrode barrier ribs 17 are formed.

After the above process, the removal of the photoresists 12P of the lattice wall formation process and the sintering of the silver paste 18A of the electrode formation process are performed simultaneously. That is, with reference to FIG. 15, the silver paste 18A is sintered for approximately 10 minutes at a temperature of roughly 550° C. (degrees Celsius) to form the second electrodes 18, and, simultaneously, the photoresists 12P are removed.

As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17. Next, the second and third dielectric layers 19 and 19' and the phosphor layers 20 are formed as in the first preferred embodiment of the present invention to complete the manufacture of the second substrate 12, after which the remaining processes for manufacturing the plasma display are performed identically as in the first preferred embodiment of the present invention.

The same advantages obtained by the first and second preferred embodiments of the present invention are obtained by the manufacturing method of the third preferred embodiment of the present invention. In more detail, according to the manufacturing process of the third preferred embodiment of the present invention, it is not necessary to perform sintering to harden the barrier ribs 15 and 17 as in the prior art. That is, it is unnecessary to perform hardening as in the prior art method, in which the barrier ribs are formed by depositing a lattice wall material then selectively removing the material. Further, a screen-printing process may be applied in the formation of the second electrodes 18 and the second and third dielectric layers 19 and 19'.

In addition, since the sintering of the silver paste 18A and the removal of the photoresist 12P are performed in the same process, the manufacturing process is simpler compared to the manufacturing processes of the first and second preferred embodiments of the present invention.

Figure 16:
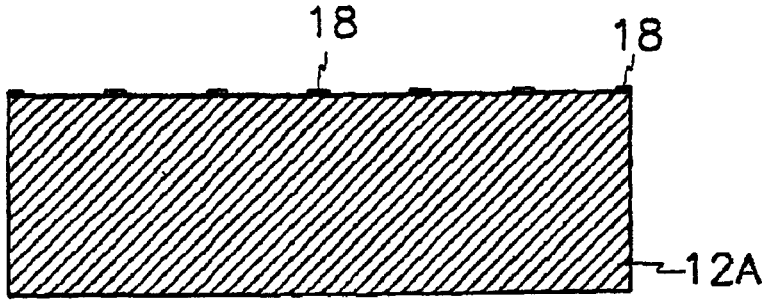
FIGS. 16 and 17 are sectional views used to describe processes in the manufacture of a plasma display according to a fourth preferred embodiment of the present invention.

A manufacturing method for a plasma display according to a fourth preferred embodiment of the present invention will be described with reference to FIGS. 16 and 17.

In the manufacturing method according to the fourth preferred embodiment of the present invention is identical to that of the second and third preferred embodiments of the present invention with respect to the manufacture of the second substrate 12 in the sequence of the electrode formation process, the lattice wall formation process, the dielectric layer formation process, and the phosphor layer formation process. However, in the fourth preferred embodiment, when sandblasting the original substrate glass 12A to perform selective removal of predetermined portions, the second electrodes 18 are used as a mask such that the photoresists 12P are not formed in a pattern corresponding to the barrier ribs 15 and 17.

Further, in the fourth preferred embodiment of the present invention, the dielectric layer formation process, the phosphor layer formation process, and the processes for completing the plasma display after manufacture of the second substrate 12 are identical to those in the first preferred embodiment of the present invention such that a detailed description will not be provided. Further, the same reference numerals will be used for elements identical to those of the first preferred embodiment and a detailed description of these elements will not be provided.

First, in the electrode formation process, after washing then drying the original substrate glass 12A, a silver paste is deposited on locations corresponding to where the main barrier ribs 15 and the electrode barrier ribs 17 will be formed, and over an area corresponding to the uppermost shape of these elements (i.e., corresponding to positions and the shape of the second electrode 18). Next, the original substrate glass 12A with the silver paste applied thereon is dried for approximately ten minutes at a temperature of roughly 150° C. (degrees Celsius) then sintered for approximately 10 minutes at a temperature of roughly 550° C. (degrees Celsius) such that the formation of the second electrodes 18 corresponding to the position and shape of the barrier ribs 15 and 17 is completed as shown in FIG. 16.

In the fourth preferred embodiment, since the second electrodes 18 act as a mask when selectively removing portions of the original substrate glass 12A, the second electrodes 18 are formed such that they are resistant to sandblasting. That is, after sintering, silver paste that is resistant to sandblasting is used to form the second electrodes 18.

Further, in the fourth embodiment, since the second electrodes 18 act as a mask when selectively removing portions of the original substrate glass 12A by a sandblasting process, barrier ribs are not formed in areas where the second electrodes 18 are not formed. Accordingly, it is necessary to form the second electrodes 18 such that the number of the second electrodes 18 corresponds to the desired number of the main barrier ribs 15 and the electrode barrier ribs 17.

Figure 17:
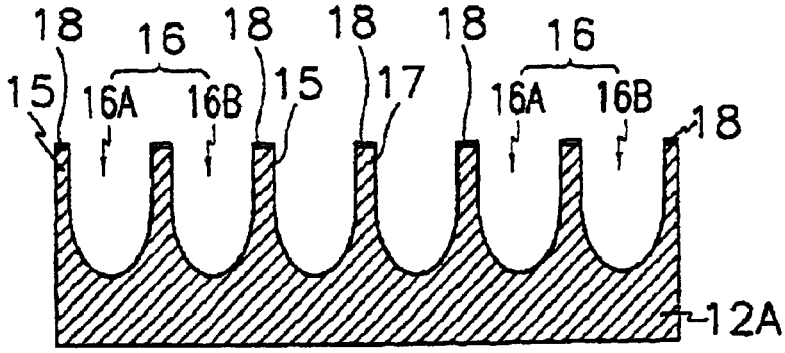

Next, in the lattice wall formation process, using the second electrodes 18 as a mask, areas where the second electrodes 18 are not formed are removed to a predetermined depth and shape using a sandblast process such that the main barrier ribs 15 and the electrode barrier ribs 17 are formed as shown in FIG. 17. As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17.

Next, the second and third dielectric layers 19 and 19' and the phosphor layers 20 are formed as in the first preferred embodiment of the present invention to complete the manufacture of the second substrate 12, after which the remaining processes for manufacturing the plasma display are performed identically as in the first preferred embodiment of the present invention.

In the fourth preferred embodiment, although the processes of sintering the silver paste is performed before removing selective portions of the original substrate glass 12A, the present invention is not limited to this sequence of processes and it is possible to perform sintering of the silver paste after sandblasting the original substrate glass 12A. In this case, a silver paste that is resistant to sandblasting is used as a mask when performing sandblasting of the original substrate glass 12A. Examples of silver paste resistant to sandblasting include powder, glass frit, and resin materials.

The same advantages obtained by the first, second, and third preferred embodiments of the present invention are obtained by the manufacturing method of the fourth preferred embodiment of the present invention. In more detail, according to the manufacturing process of the fourth preferred embodiment of the present invention, it is not necessary to perform sintering to harden the barrier ribs 15 and 17 as in the prior art. That is, it is unnecessary to perform hardening as in the prior art method, in which the barrier ribs are formed by depositing a lattice wall material then selectively removing the material. Further, a screen-printing process may be applied in the formation of the second electrodes 18 and the second dielectric layers 19 and 19'.

In addition, since the depositing, exposure, and developing of the photoresists are not required, the manufacturing process of the fourth preferred embodiment is simpler and less costly compared to the manufacturing processes of the first, second, and third preferred embodiments of the present invention.

In the manufacturing methods according to the first through fourth preferred embodiments of the present invention, although the lattice wall formation process, the electrode formation process, the dielectric layer formation process, and the phosphor layer formation process are performed as individual procedures, the present invention is not limited to such a method and a plurality of the processes may be performed simultaneously. This will be described below in manufacturing methods according to fifth and sixth preferred embodiments.

Figure 18:
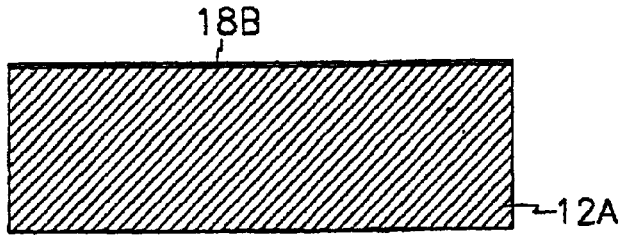
FIGS. 18 through 20 are sectional views used to describe processes in the manufacture of a plasma display according to a fifth preferred embodiment of the present invention.

A manufacturing method for a plasma display according to a fifth preferred embodiment of the present invention will be described with reference to FIGS. 18, 19, and 20. In the fifth preferred embodiment of the present invention, the lattice wall formation process and the electrode formation process are performed simultaneously.

In the fifth preferred embodiment of the present invention, the dielectric layer formation process, the phosphor layer formation process, and the processes for completing the plasma display after manufacture of the second substrate 12 are identical to those in the first preferred embodiment of the present invention such that a detailed description will not be provided. Further, the same reference numerals will be used for elements identical to those of the first preferred embodiment and a detailed description of these elements will not be provided.

First, after washing then drying the original substrate glass 12A, a silver paste is deposited over an entire upper surface (in the drawing) of the original substrate glass 12A. Next, the original substrate glass 12A with the silver paste applied thereon is dried for approximately 10 minutes at a temperature of roughly 150° C. (degrees Celsius) then sintered for approximately 10 minutes at a temperature of roughly 550° C. (degrees Celsius) such that an electrode material 18B is formed over the entire surface of the original substrate glass 12A as shown in FIG. 18.

Subsequently, a sheet-type photoresist such as a DFR, which is resistant to sandblasting, is applied to the upper surface of the original substrate glass 12A on which the electrode material 18B is applied. The photoresist is then exposed and developed using a mask such that photoresists 12P are formed in a predetermined pattern as shown in FIG. 18, in which the predetermined pattern corresponds to locations and the shape of the main barrier ribs 15 and the electrode barrier ribs 17.

Figure 19:
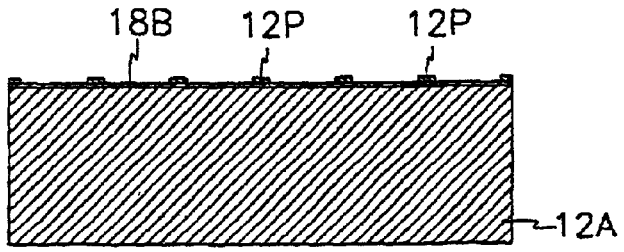
Figure 20:
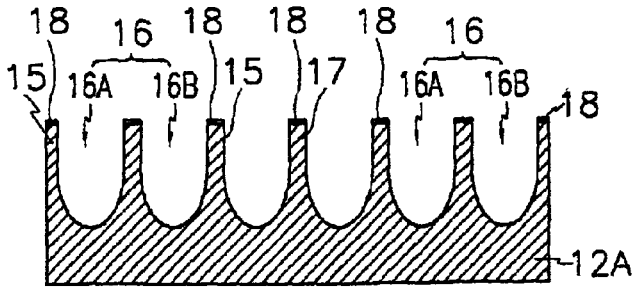

Next, areas where the photoresists 12P of the original substrate glass 12A are not formed are removed to a predetermined depth and shape using a sandblast process such that the main barrier ribs 15, the electrode barrier ribs 17, and the second electrodes 18 are formed in a single process to result in the configuration shown in FIG. 19. In the drawing, the photoresists 12P have been peeled away following this process. As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17.

Next, the second and third dielectric layers 19 and 19' and the phosphor layers 20 are formed as in the first preferred embodiment of the present invention to complete the manufacture of the second substrate 12, after which the remaining processes for manufacturing the plasma display are performed identically as in the first preferred embodiment of the present invention.

The same advantages obtained by the first through fourth preferred embodiments of the present invention are obtained by the manufacturing method of the fifth preferred embodiment of the present invention. In more detail, according to the manufacturing process of the fifth preferred embodiment of the present invention, it is not necessary to perform sintering to harden the barrier ribs 15 and 17 as in the prior art. That is, it is unnecessary to perform hardening as in the prior art method, in which the barrier ribs are formed by depositing a lattice wall material, then selectively removing the material. Further, a screen-printing process may be applied in the formation of the second electrodes 18 and the second dielectric layers 19 and 19'.

In addition, since the lattice wall formation process and the electrode formation process are performed as a single process, the manufacturing process of the fifth preferred embodiment is simpler and less costly compared to the manufacturing processes of the first through fourth preferred embodiments of the present invention.

A manufacturing method of a plasma display according to a sixth preferred embodiment of the present invention will be described with reference to FIGS. 20 through 23.

In the fifth preferred embodiment of the present invention, the lattice wall formation process and the electrode formation process are performed simultaneously. In the sixth preferred embodiment of the present invention, the lattice wall formation process, the electrode formation process, and the dielectric layer formation process are performed as a single process.

In the sixth preferred embodiment of the present invention, the phosphor layer formation process and the processes for completing the plasma display after manufacture of the second substrate 12 are identical to those in the first preferred embodiment of the present invention such that a detailed description will not be provided. Further, the same reference numerals will be used for elements identical to those of the first preferred embodiment and a detailed description of these elements will not be provided.

First, after washing then drying the original substrate glass 12A, a silver paste is deposited over an entire upper surface (in the drawing) of the original substrate glass 12A. Next, as in the fifth preferred embodiment, the original substrate glass 12A with the silver paste applied thereon is dried and sintered as in the fifth preferred embodiment such that an electrode material 18B is formed over the entire surface of the original substrate glass 12A as shown in FIG. 20. Subsequently, a dielectric material paste is deposited over the entire surface of the original substrate glass 12A on which the electrode material 18B is formed. Next, the original substrate glass 12A with the dielectric material paste applied thereon is dried for approximately 10 minutes at a temperature of roughly 150° C. (degrees Celsius) then sintered for approximately 10 minutes at a temperature of roughly 550° C. (degrees Celsius) to result in the formation of a dielectric material layer 19A on the electrode material 18B as shown in FIG. 21.

Figure 21:
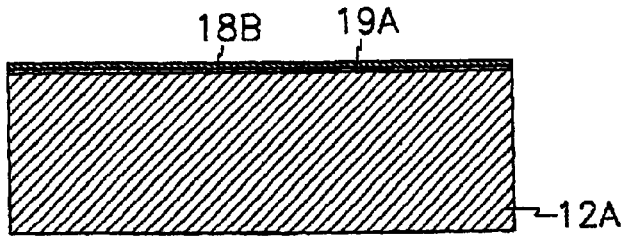
FIGS. 21 through 23 are sectional views used to describe processes in the manufacture of a plasma display according to a sixth preferred embodiment of the present invention.

Alternatively, drying and sintering are not performed after the formation of the electrode paste, and instead, the dielectric material paste is applied on top of the electrode paste, after which the electrode paste and dielectric material paste are dried and sintered simultaneously to result in the formation of a dielectric material layer 19A on the electrode material 18B as shown in FIG. 21.

Figure 22:
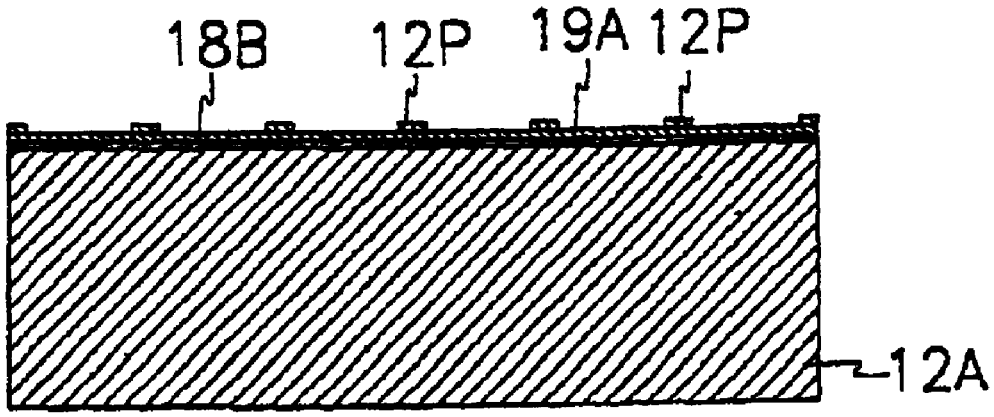

Next, a sheet-type photoresist such as a DFR, which is resistant to sandblasting, is applied to the upper surface of the original substrate glass 12A on which is applied the electrode material 18B and the dielectric material layer 19A. The photoresist is then exposed and developed using a mask such that photoresists 12P are formed in a predetermined pattern as shown in FIG. 22, in which the predetermined pattern corresponds to locations and the shape of the main barrier ribs 15 and the electrode barrier ribs 17.

Figure 23:
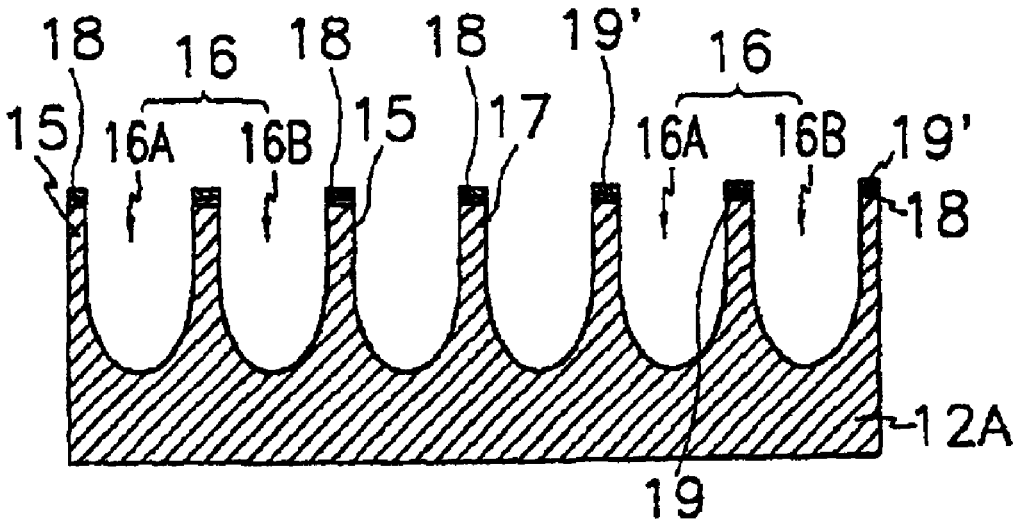

Next, areas where the photoresists 12P of the original substrate glass 12A are not formed are removed to a predetermined depth and shape using a sandblast process such that the main barrier ribs 15, the electrode barrier ribs 17, the second electrodes 18, and the second and third dielectric layers 19 and 19' are formed in a single process to result in the configuration shown in FIG. 23. In the drawing, the photoresists 12P have been peeled away following this process. As a result, the partitioned discharge cells 16A and 16B are formed between the main barrier ribs 15 and the electrode barrier ribs 17. That is, each of the discharge cells 16 formed between the main barrier ribs 15 are divided by the formation of the electrode barrier ribs 17 to form a pair of the partitioned discharge cells 16A and 16B for each electrode lattice wall 17.

Next, the phosphor layers 20 are formed as in the first preferred embodiment of the present invention to complete the manufacture of the second substrate 12, after which the remaining processes for manufacturing the plasma display are performed identically as in the first preferred embodiment of the present invention.

The same advantages obtained by the first through fifth preferred embodiments of the present invention are obtained by the manufacturing method of the sixth preferred embodiment of the present invention. In more detail, according to the manufacturing process of the sixth preferred embodiment of the present invention, it is not necessary to perform sintering to harden the barrier ribs 15 and 17 as in the prior art. That is, it is unnecessary to perform hardening as in the prior art method, in which the barrier ribs are formed by depositing a lattice wall material then selectively removing the material. Further, a screen-printing process may be applied in the formation of the second electrodes 18 and the second dielectric layers 19 and 19'.

In addition, since the lattice wall formation process, the electrode formation process, and the dielectric layer formation process are performed as a single process, the manufacturing process of the sixth preferred embodiment is simpler and less costly compared to the manufacturing processes of the first through sixth preferred embodiments of the present invention.

A plasma display and a manufacturing method thereof according to a seventh preferred embodiment of the present invention will now be described.

Figure 24:
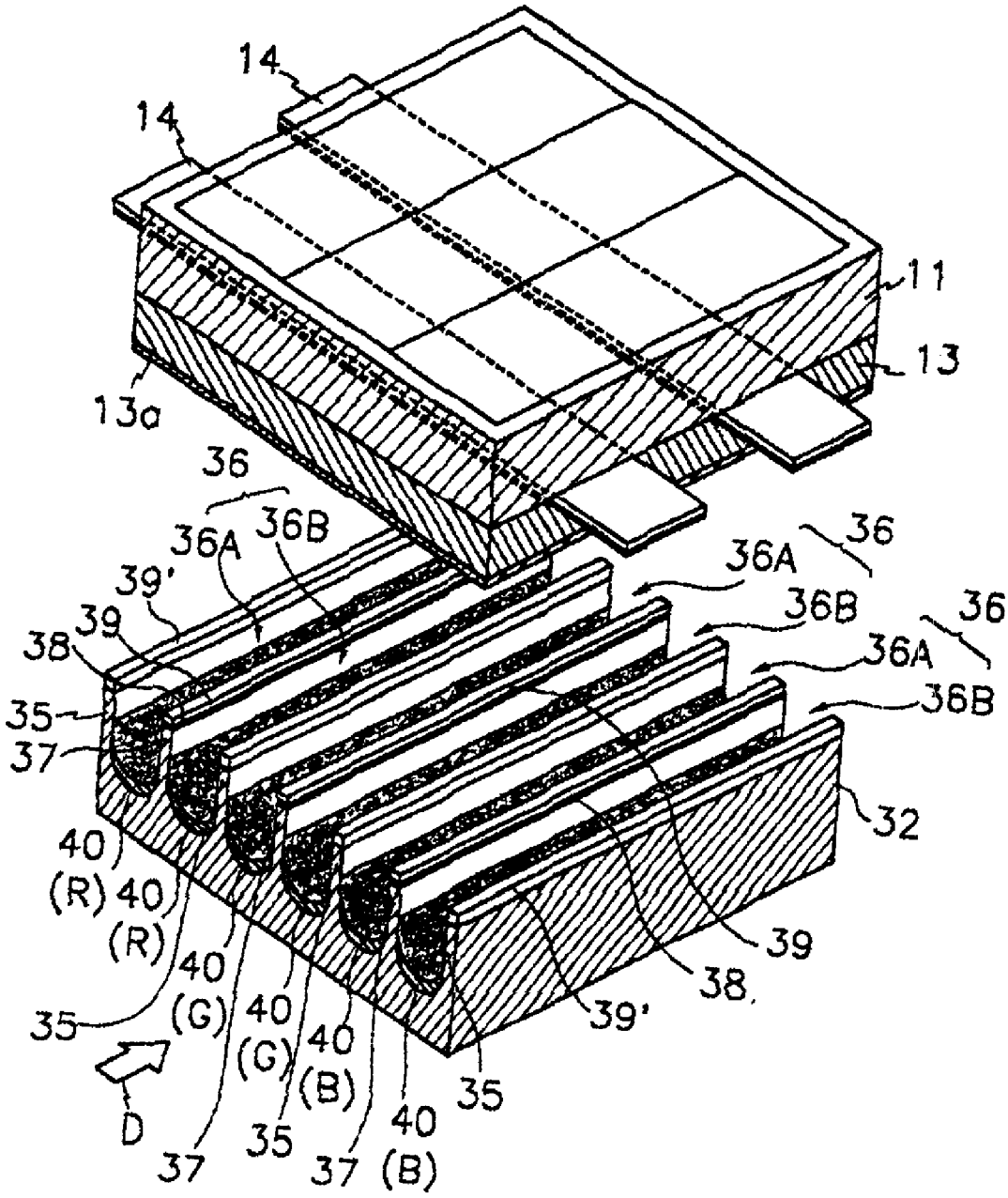
FIG. 24 is a partial exploded perspective view of a plasma display according to a seventh preferred embodiment of the present invention.
Figure 25:
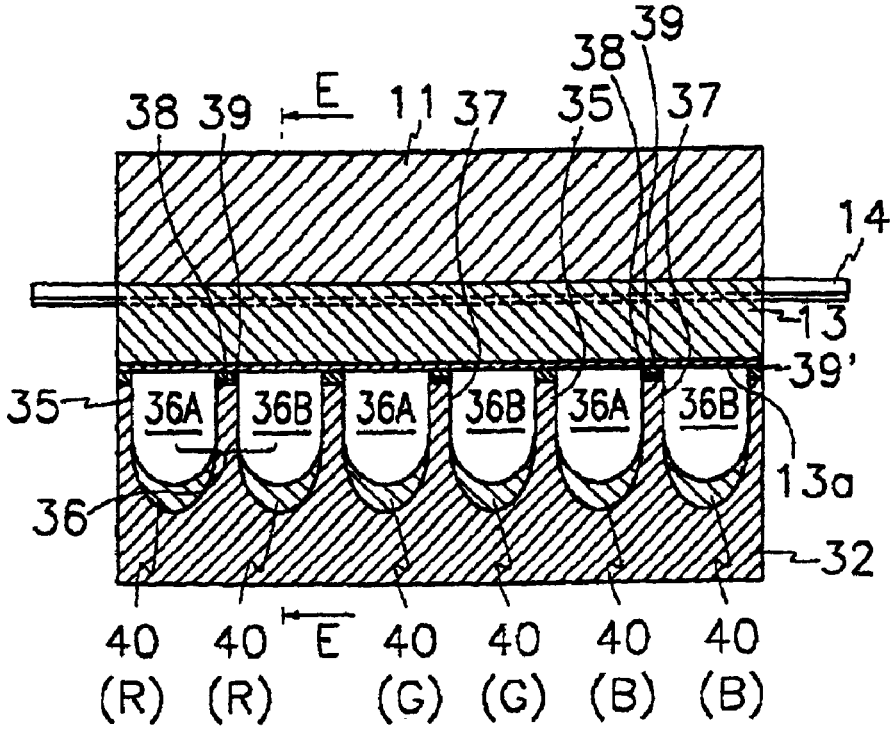
FIG. 25 is a sectional view of the plasma display of FIG. 24, in which the plasma display is assembled and the view is taken in the direction shown by arrow D of FIG. 24.
Figure 26:
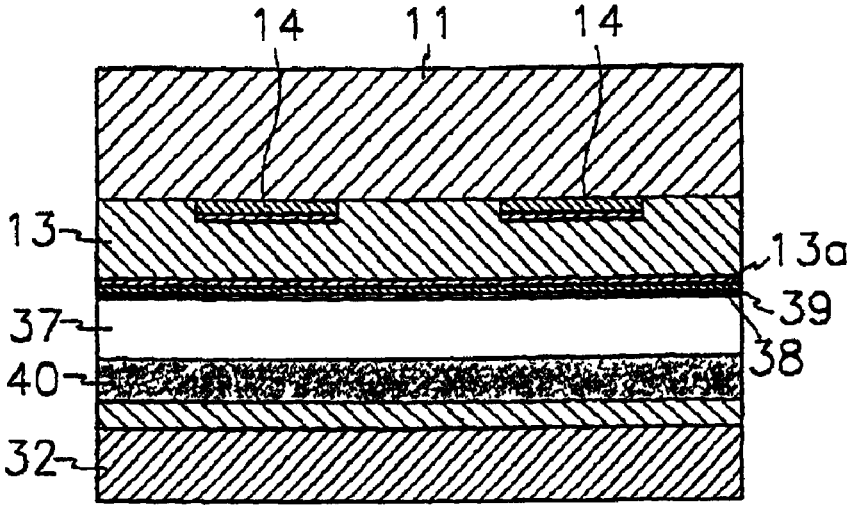
FIG. 26 is a sectional view taken along line E—E of FIG. 25.

FIG. 24 is a partial exploded perspective view of a plasma display according to a seventh preferred embodiment of the present invention, FIG. 25 is a sectional view of the plasma display of FIG. 24, in which the plasma display is assembled and the view is taken in the direction shown by arrow D of FIG. 24, FIG. 26 is a sectional view taken along line E—E of FIG. 25, and FIGS. 27 through 35 are views shown from the direction of arrow D of FIG. 24 used to describe processes in the manufacture of the plasma display of FIG. 24.

In comparing a plasma display according to a seventh preferred embodiment of the present invention with the plasma display according to the first preferred embodiment of the present invention, first substrates of the two embodiments are identical in structure whereas second substrates of the two embodiments are different. Accordingly, the same reference numeral of 11 will be used for the first substrate in the description that follows, while reference numeral 32 will be used for the second substrate.

The plasma display according to the seventh preferred embodiment of the present invention, with reference to FIGS. 24 through 26, includes the first and second substrates 11 and 32 made of glass provided opposing one another. A plurality of first electrodes 14 are formed on an inside surface of the first substrate 11, and a first dielectric layer 13, which includes a protection layer 13*a* made of a compound such as MgO, is formed covering the first electrodes 14.

With respect to the second substrate 32, a plurality of main barrier ribs (also called main lattice walls) 35 are integrally formed on the second substrate 32 protruding from a surface of the same that opposes the first substrate 11. A plurality of discharge cells 36 are defined by the formation of the main barrier ribs 35. Also, a plurality of electrode barrier ribs (also called electrode lattice walls) 37 are formed between the main barrier ribs 35 and in the same manner as the main barrier ribs 35. Mounted on a distal end of each of the electrode barrier ribs 37 is a second electrode 38. Further, mounted on each of the second electrodes 38 is a second dielectric layer 39, and mounted on a distal end of each of the main barrier ribs 35 is a third dielectric layer 39'.

With the above structure, the main barrier ribs 35, the discharge cells 36, the electrode barrier ribs 37, the second electrodes 38, and the second and third dielectric layers 39 and 39' are all formed in the same direction, that is, in parallel. The first electrodes 14 of the first substrate 11 are formed perpendicular to the elements of the second substrate 32. Further, the electrode barrier ribs 37 are provided at substantially a center between a pair of main barrier ribs 35

(i.e., a center of a width of the discharge cells 36). Further, the second electrodes 38 are formed along an upper end of the electrode barrier ribs 37 as described above, and the second dielectric layers 39 are formed covering the second electrodes 38. The third dielectric layers 39' are formed along an upper end of the main barrier ribs 35.

In the seventh preferred embodiment of the present invention, each of the main barrier ribs 35 and the electrode barrier ribs 37 is formed at a substantially identical height. That is, each of the third dielectric layers 39' formed on the main barrier ribs 35 is at a thickness substantially identical to a combined thickness of a pair of the second electrodes 38 and the second dielectric layers 39 formed on the electrode barrier ribs 37, thereby resulting in substantially the same heights for the main barrier ribs 35 and the electrode barrier ribs 37. As a result, no gaps result when the first substrate 11 is assembled to the second substrate 32.

Each electrode lattice wall 37 divides each discharge cell 36 formed between the main barrier ribs 35 into a plurality of partitioned discharge cells. That is, each discharge cell 36 is divided equally into two partitioned discharge cells 36A and 36B. The partitioned discharge cells 36A and 36B are used as spaces in which gas discharge is performed. R, G, B (red, green, blue) phosphor layers 40 are formed on a bottom surface of the partitioned discharge cells 36A and 36B.

Either a red, green, or blue phosphor layer 40 is formed in one discharge cell 36. However, with the formation of the electrode barrier ribs 37 between the main barrier ribs 35, the phosphor layers 40 formed in each pair of the partitioned discharge cells 36A and 36B are of the same color.

After the first and second substrates 11 and 32 structured as in the above are provided one placed on top of the other, the first and second substrates 11 and 32 are sealed in a state where a discharge gas such as Ne or He is provided in the discharge cells 36.

A voltage is selectively provided to terminals connected to the first and second electrodes 14 and 38 protruding from the sealed substrates 11 and 32, thereby generating discharge between the first and second electrodes 14 and 38 in the discharge cells 36. As a result of the discharge, excitation light emitted from the phosphor layers 40 in the discharge cells 36 (i.e., the partitioned discharge cells 36A and 36B) is displayed externally.

The second substrate 32 of the plasma display structured as in the above is manufactured roughly as described below. That is, manufacture of the second substrate 32 includes an electrode formation process, in which the second electrodes 38 are formed on an upper surface of an original substrate glass; a dielectric layer formation process, in which the second and third dielectric layers 39 and 39' are formed respectively on the second electrodes 38 formed on the electrode barrier ribs 37 and on the original substrate glass at a location where the main barrier ribs 35 will be formed; a main lattice wall formation process, in which the original substrate glass is cut and the main barrier ribs 35 are formed integrally to the cut glass; an electrode lattice wall formation process, in which the electrode barrier ribs 37 are formed integrally to the original substrate glass by cutting the same between the main barrier ribs 35; and a phosphor layer formation process, in which the phosphor layers 40 are formed in each discharge cell 36, that is, each of the partitioned discharge cells 36A and 36B. The main lattice wall formation process and the electrode lattice wall formation process are performed simultaneously. Accordingly, the two processes will be referred to as simply the lattice wall formation process, hereinafter.

Figure 27:
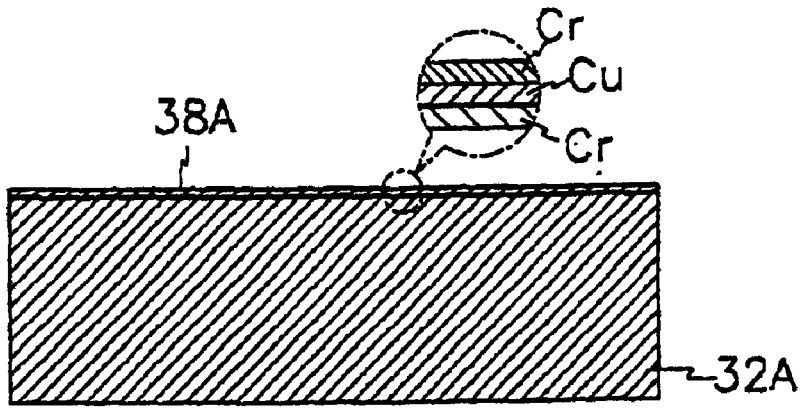
FIGS. 27 through 30, and 32 through 35 are sectional views used to describe processes in the manufacture of a plasma display according to a seventh preferred embodiment of the present invention.

Each of the manufacturing processes of the second substrate 32 will be described in more detail. First, after washing then drying the original substrate glass, an electrode sheet 38A is formed on the upper surface of an original substrate glass 32A as shown in FIG. 27 by applying Cr, Cu, and Cr thereon in this sequence.

Figure 28:
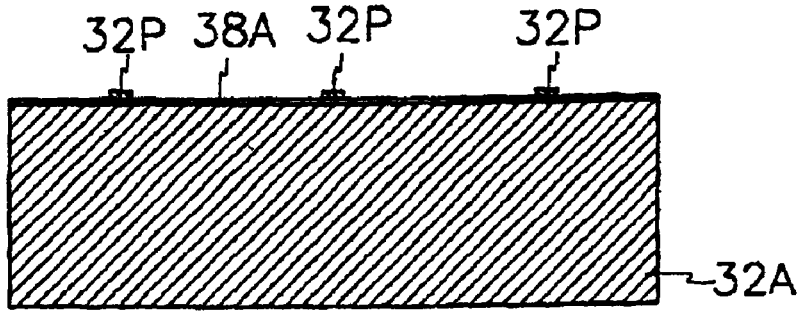

Next, with reference to FIG. 28, etching resists 32P in a pattern corresponding to locations where the second electrodes 38 will be formed and an upper surface shape of the same are applied on the electrode sheet 38A. At this time, the etching resists 32P are patterned such that the second electrodes 38 are formed only on the electrode barrier ribs 37.

Figure 29:
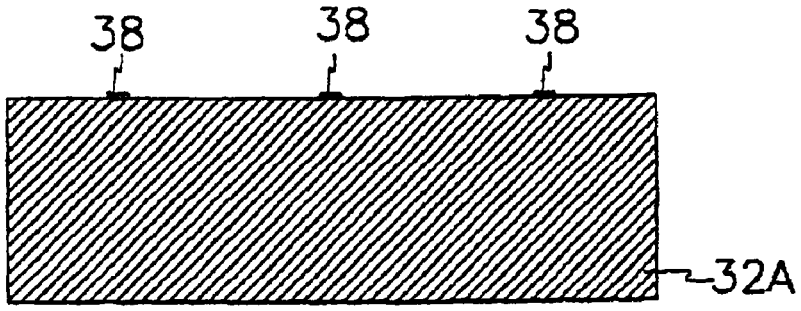

The electrode sheet 38A is then removed in all areas except where the etching resists 32P are formed such that the second electrodes 38 are formed as shown in FIG. 29.

The dielectric layer formation process is performed next. In this process, a dielectric paste (for example, GLP-86087 produced by Sumitomo Metal Mining Co., Ltd.) is deposited corresponding to where the barrier ribs 35 and 37 will be formed and corresponding to an upper surface shape of the same using a screen-printing process. At this time, the dielectric paste provided for the main barrier ribs 35 is formed such that a thickness of the dielectric paste exceeds a thickness of the dielectric paste provided for the electrode barrier ribs 37 by as much as a thickness of the second electrodes 38. Since the printing of the dielectric paste for the main barrier ribs 35 is performed separately from the printing of the dielectric paste for the electrode barrier ribs 37, the thicknesses of the dielectric paste may be made to appropriate dimensions.

Further, in the case where the thickness of the second electrodes 38 is so minimal that it can be ignored when compared to the thicknesses of the second and third dielectric layers 39 and 39', it is not necessary to perform printing of the dielectric for the main barrier ribs 35 and the electrode barrier ribs 37 separately.

Figure 30:
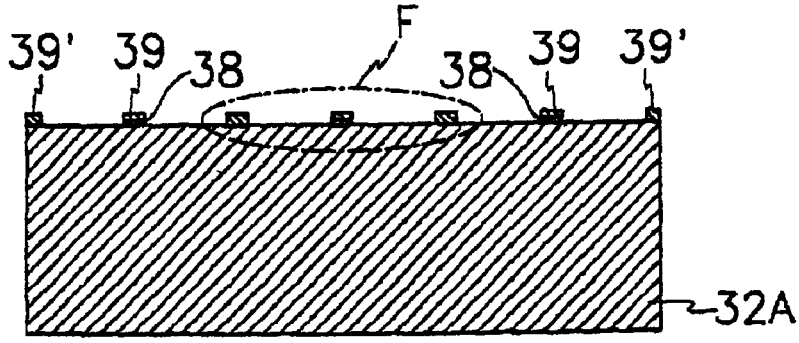
Figure 31:
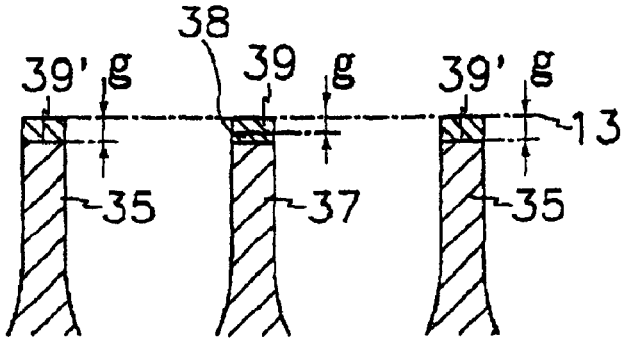
FIG. 31 is an enlarged sectional view of area F of FIG. 30.

Subsequently, the original substrate glass 32A with the dielectric paste applied thereon is dried for approximately ten minutes at a temperature of roughly 150° C. (degrees Celsius) then sintered for approximately 10 minutes at a temperature of roughly 550° C. (degrees Celsius) such that the formation of the second and third dielectric layers 39 and 39' is completed as shown in FIGS. 30 and 31.

Figure 32:
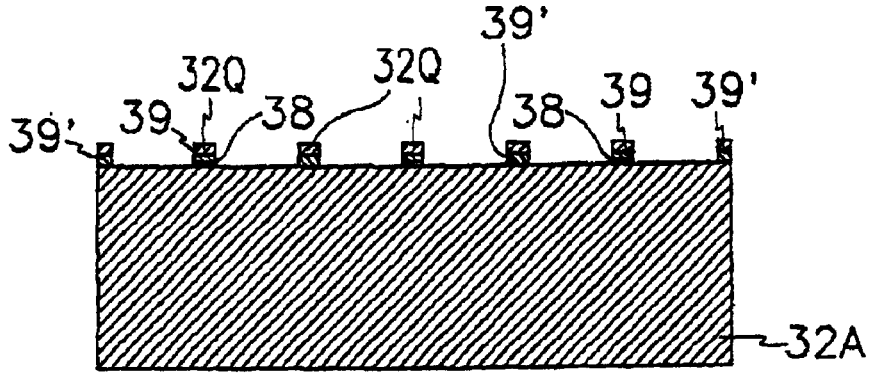

The lattice wall formation process will now be described. First, a sheet-type photoresist such as a dry film resist (DFR), which is resistant to sandblasting, is applied to the upper surface of the original substrate glass 32A (results of this process are not shown). The photoresist is exposed and developed using a mask such that photoresists 32Q are formed in a predetermined pattern that correspond to locations and an upper-surface shape of the main barrier ribs 35 and the electrode barrier ribs 37 as shown in FIG. 32.

Figure 33:
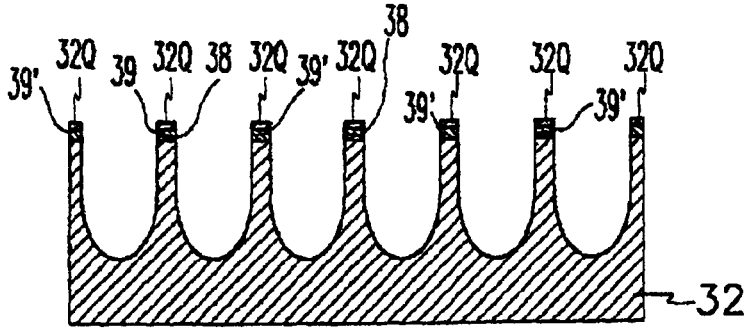
Figure 34:
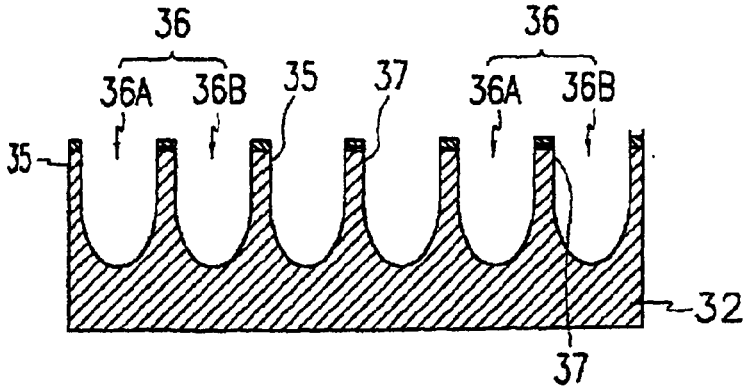

Subsequently, with reference to FIG. 33, areas where the photoresists 32Q of the original substrate glass 32A are not formed are removed to a predetermined depth and shape using a sandblast process such that the main barrier ribs 35 and the electrode barrier ribs 37 are formed. In the drawing, the photoresists 32Q have been peeled away following this process. As a result, the partitioned discharge cells 36A and 36B are formed between the main barrier ribs 35 and the electrode barrier ribs 37. That is, each of the discharge cells 36 formed between the main barrier ribs 35 are divided by the formation of the electrode barrier ribs 37 to form a pair of the partitioned discharge cells 36A and 36B for each electrode lattice wall 37.

With respect to the sandblast process, since materials such as calcium carbonate or glass beads do not provide sufficient cutting strength to the original substrate glass 32A, which is made of a material such as soda lime glass, the desired removal of portions of the original substrate glass 32A may not be achieved. Accordingly, it is preferable that stronger materials such as silundum powder or alumina be used for the sandblast process.

In this case, it is preferable that a DFR be selected according to its adhesive strength to the original substrate glass 32A and resistance to sandblasting.

Further, in the lattice wall formation process, a process is described in which the main barrier ribs 35 and the electrode barrier ribs 37 are formed integrally in the original substrate glass 32A using a sandblasting process. However, the present invention is not limited to this method of lattice wall formation and it is possible to form the barrier ribs using other methods such as a chemical etching process, etc.

Next, in the phosphor layer formation process, with reference to FIG. 24, three types of phosphor paste (red, green, and blue phosphor paste) are selectively printed on an innermost portion of each discharge cell 36, that is, an innermost portion of each partitioned discharge cell 36A and 36B. At this time, the phosphor paste is deposited such that the same color of phosphor paste is provided in pairs of the partitioned discharge cells 36A and 36B divided by one of the electrode barrier ribs 37.

Figure 35:
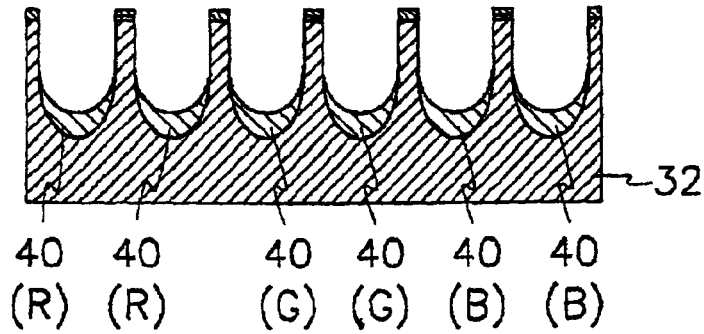

As a phosphor powder used to make the phosphor paste, a green phosphor material (for example, P1G1 produced by Kasei Optonix, Ltd.), a red phosphor material (for example, KX504A made by the same company), and a blue phosphor material (for example, KX501A made by the same company) are mixed in suitable quantities to a screen-printing vehicle (for example, the screen printing vehicle produced by Okuno Chemical Industries Co., Ltd.). The phosphor paste is formed in a predetermined pattern using a screen-printing process. Subsequently, the original substrate glass 32A with the phosphor paste applied thereon is dried for approximately ten minutes at a temperature of roughly 150° C. (degrees Celsius) then sintered for approximately 10 minutes at a temperature of roughly 450° C. (degrees Celsius) such that the formation of the phosphor layers 40 is completed as shown in FIG. 35.

After the above processes, the second substrate 32 manufactured as described above is placed in close contact with the completed first substrate 1, and the first and second substrates 11 and 32 are sealed using sealant glass (not shown) where the first and second substrates 11 and 32 meet and in a state where discharge gas such as Ne or He is provided in the discharge cells 36. Connections are made with the terminals (not shown) of the first and second electrodes 14 and 38 to allow the application of a voltage thereto. Accordingly, the plasma display is completed.

In the plasma display according to the seventh preferred embodiment of the present invention, with respect to the second substrate 32, each main lattice wall 35 is formed integrally to the original substrate glass 32A, the electrode barrier ribs 37 are formed integrally to the original substrate glass 32A between each of the main barrier ribs 35, and the second electrodes 38 and the second dielectric layers 39 are formed on the upper end of the electrode barrier ribs 37.

Further, the manufacturing process of the second substrate 32 includes the electrode formation process of forming the second electrodes on the upper surface of the original substrate glass 32A; the dielectric layer formation process of forming the second and third dielectric layers 39 respectively on the second electrodes 38 and on the original substrate glass 32A at areas where the main barrier ribs are to be positioned; the lattice wall formation process, in which the original substrate glass 32A is cut to form the main barrier ribs 35 integrally to the original substrate glass 32A, and in which the electrode barrier ribs 37 are formed integrally to the original substrate glass by cutting the same between the main barrier ribs 35; and the phosphor layer formation process, in which the phosphor layers 40 are formed in each discharge cell 36.

Accordingly, in the plasma display and method for manufacturing the same according to the seventh preferred embodiment of the present invention, since the main barrier ribs 35 and the electrode barrier ribs 37 are formed integrally to the original substrate glass 32A by cutting the original substrate glass 32A, it is not necessary to perform sintering to harden the barrier ribs 35 and 37 as in the prior art. That is, it is unnecessary to perform hardening as in the prior art method, in which the barrier ribs are formed by depositing a lattice wall material then selectively removing the material.

Also, the second electrodes 38 and the second and third dielectric layers 39 and 39' of the seventh preferred embodiment of the present invention are not formed at an innermost portion between the barrier ribs 35 and 37 as in the prior art, and instead are formed at the uppermost end of the electrode barrier ribs 37. As a result, when forming the second electrodes 38 and the second and third dielectric layers 39 and 39' using the screen-printing process, the difficult process of providing the materials used for these elements to the innermost portions between the main barrier ribs 35 as in the prior art is not required. Accordingly, in the seventh preferred embodiment of the present invention, a sintering process is not needed in the formation of the main barrier ribs 35, and further, a screen-printing process may be applied in the formation of the second electrodes 38 and the second and third dielectric layers 39 and 39'.

In addition, with respect to the second substrate 32 in the plasma display according to the seventh preferred embodiment of the present invention, with the formation of the second electrodes 38 and the second dielectric layers 39 on the electrode barrier ribs 37, and the third dielectric layers 39' on the main barrier ribs 35 such that the thickness of each of the third dielectric layers 39' is substantially identical to the combined thickness of each pair of the second electrodes 38 and the second dielectric layers 39, the uppermost surface of the dielectric layers 39' of the main barrier ribs 35 are at the same height of the uppermost surface of the dielectric layers 39 of the electrode barrier ribs 37. With this configuration, no gaps are formed when the first substrate 11 is assembled to the second substrate 32 such that the discharge cells 36 and the partitioned discharge cells 36A and 36B are completely sealed.

In the manufacturing method of the plasma display according to the seventh preferred embodiment of the present invention, the second electrodes 38 are formed only on the electrode barrier ribs 37 and not on the main barrier ribs 35. Since dummy electrodes are not formed on the main barrier ribs 35, significantly less electrode material (electrode sheet) is required such that overall manufacturing costs are reduced.

Further, in the manufacturing method of the seventh preferred embodiment, the lattice wall formation process and the electrode wall formation process are performed simultaneously. Accordingly, the overall number of processes is reduced to thereby minimize manufacturing costs.

Also, this allows the height of the main barrier ribs 35 to be easily and precisely made the same as the height of the electrode barrier ribs 37.

In the manufacturing method according to the first preferred embodiment of the present invention, although the processes are performed in the sequence of the electrode formation process, dielectric layer formation process, lattice wall formation process, and the phosphor layer formation process, the present invention is not limited to such a sequence of processes. It is possible to perform the dielectric layer formation process following the lattice wall formation process, or, as in the first preferred embodiment of the present invention, the electrode formation process, the dielectric layer formation process, and the phosphor layer formation process following the lattice wall formation process.

Further, the seventh preferred embodiment is not limited to separately performing the lattice wall formation process, the electrode formation process, the dielectric layer formation process, and the phosphor layer formation process, and it is possible to perform some of the processes simultaneously as in the fifth and sixth preferred embodiments. In particular, it is possible to simultaneously perform the lattice wall formation process and the electrode formation process, or the lattice wall formation process, the electrode formation process, and the dielectric layer formation process.

Figure 41:
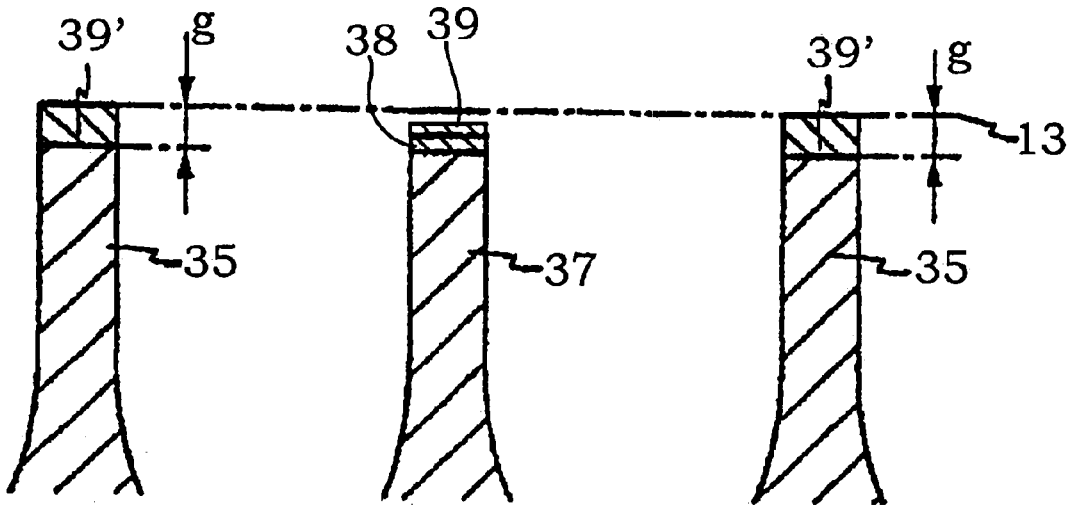
Figure 42:
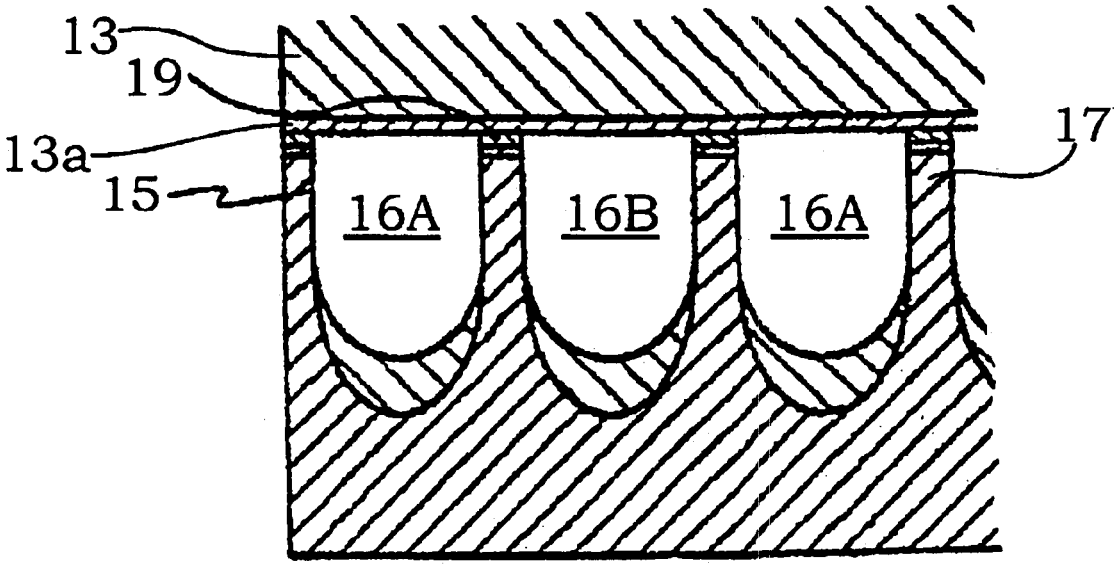
FIG. 42 is a sectional view of the plasma display of FIG. 1 showing the lattice walls, in which the plasma display is assembled and the view is taken in the direction shown by arrow A of FIG. 1.

Also, in the first and seventh preferred embodiments of the present invention, although the upper surfaces of the dielectric layers on the main barrier ribs and the upper surfaces of the dielectric layers on the electrode barrier ribs are of the same height, the present invention is not limited to this configuration and the heights may different as seen in FIG. 41.

In order to prevent discharge leakage between discharge cells of different colors while having a structure in which the upper surfaces of the dielectric layers 39' on the main barrier ribs 35 and the upper surfaces of the dielectric layers 39 on the electrode barrier ribs 37 are of differing heights, it is preferable that, in the case where a height of the upper surfaces of the dielectric layers formed on the main barrier ribs defining the discharge cells are equally provided, the dielectric layers are formed such that the upper surfaces of the dielectric layers 39' formed on the main barrier ribs 35 are 10–50 $\mu$m higher than the upper surfaces of the dielectric layers 39 formed on the electrode barrier ribs 37.

In order to prevent discharge leakage between discharge cells of different colors while having a structure in which the upper surfaces of the dielectric layers on the main barrier ribs and the upper surfaces of the dielectric layers on the electrode barrier ribs are of differing heights, it is preferable that, in the case where a height of the upper surfaces of the dielectric layers formed on the main barrier ribs defining the discharge cells are equally provided, the dielectric layers are formed such that the upper surfaces of the dielectric layers formed on the main barrier ribs are 10–50 $\mu$m higher than the upper surfaces of the dielectric layers formed on the electrode barrier ribs.

In this way, the upper surfaces of the dielectric layers of each main lattice wall are higher than the upper surfaces of the dielectric layers of each electrode lattice wall such that gaps are formed between the dielectric layers of the electrode barrier ribs of the rear substrate and the forward substrate, thereby enabling each pair of partitioned discharge cells to communicate through the gaps. Therefore, each pair of the partitioned discharge cells including one discharge cell performs the discharge operation together such that the discharge effectiveness is improved to minimize the required drive voltage. Further, as described in the seventh preferred embodiment, the dielectric paste is printed individually on the main barrier ribs and on the electrode barrier ribs such that the thickness of the dielectric layers may be formed differently.

A plasma display according to an eighth preferred embodiment of the present invention will now be described.

Figure 36:
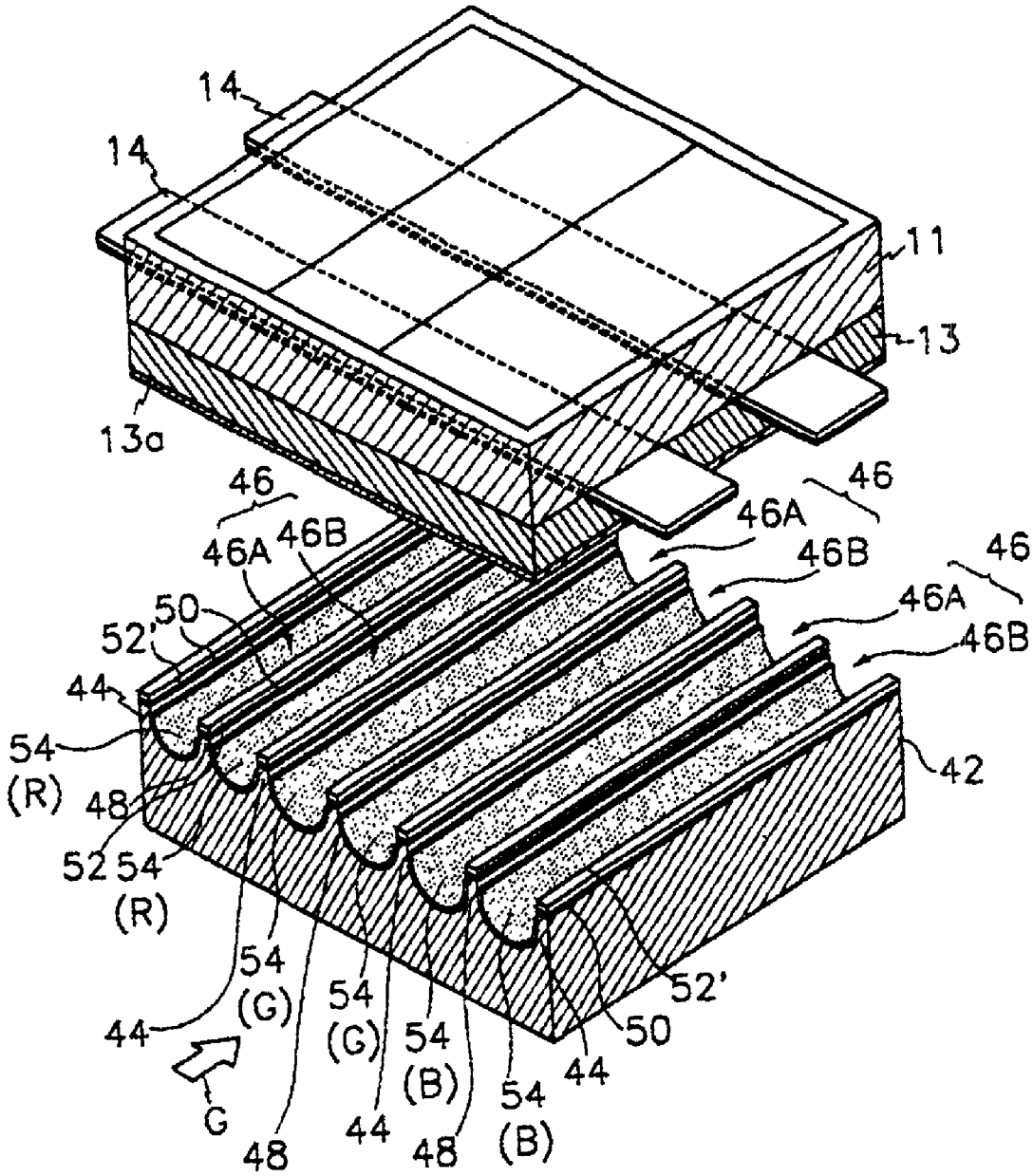
FIG. 36 is a partial exploded perspective view of a plasma display according to an eighth preferred embodiment of the present invention.
Figure 37:
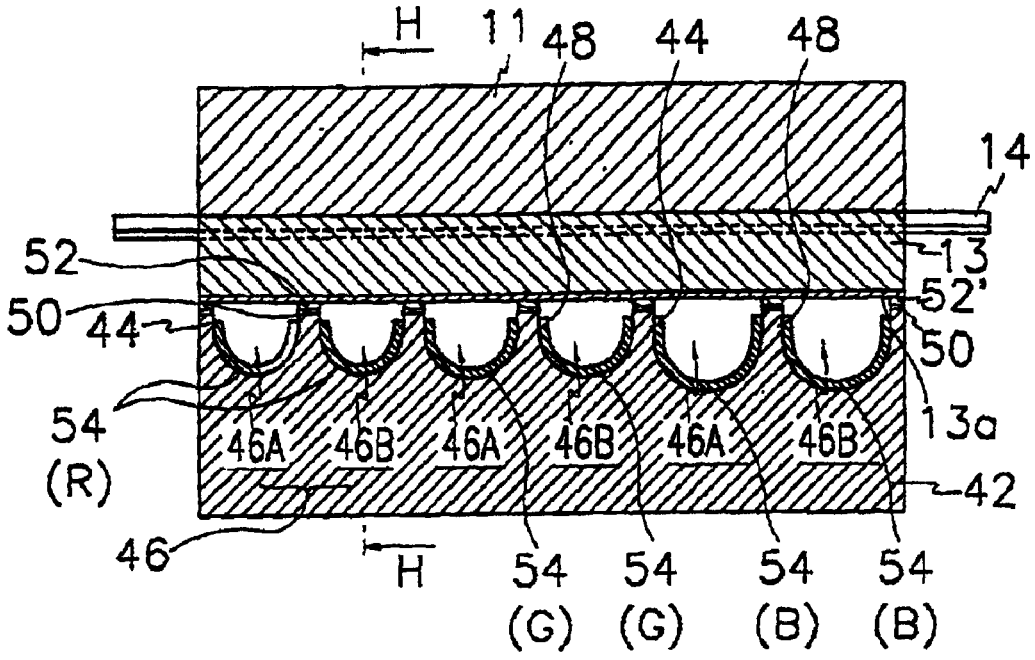
FIG. 37 is a sectional view of the plasma display of FIG. 36, in which the plasma display is assembled and the view is taken in the direction shown by arrow G of FIG. 36.
Figure 38:
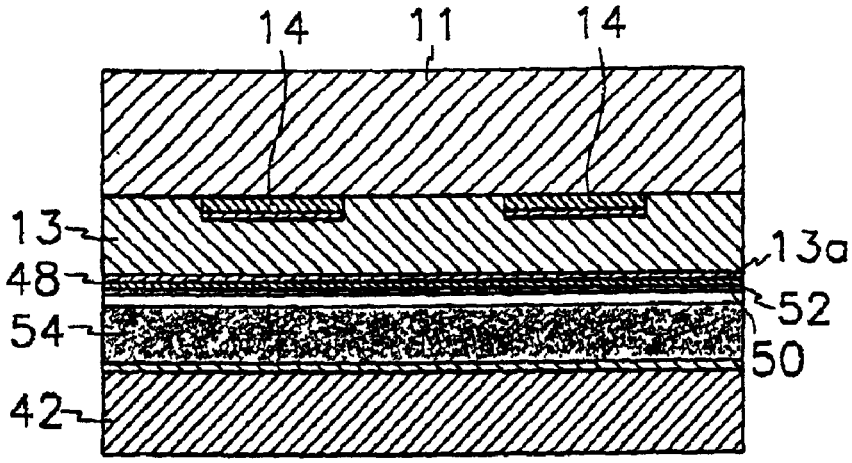
FIG. 38 is a sectional view taken along line H—H of FIG. 37.
Figure 39:
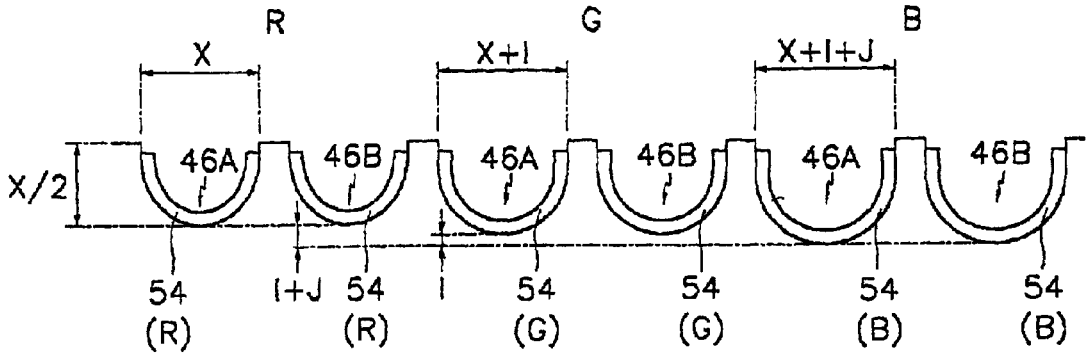
FIG. 39 is a sectional view used to describe the relation between a width and a length of partitioned discharge cells, and an area of phosphor layers.

FIG. 36 is a partial exploded perspective view of a plasma display according to an eighth preferred embodiment of the present invention, FIG. 37 is a sectional view of the plasma display of FIG. 36, in which the plasma display is assembled and the view is taken in the direction shown by arrow G of FIG. 36, FIG. 38 is a sectional view taken along line H—H of FIG. 37, and FIG. 39 is a sectional view used to describe the relation between a width and a length of partitioned discharge cells, and an area of a phosphors layer, and shows only the partitioned cells and corresponding phosphor layers.

In comparing a plasma display according to an eighth preferred embodiment of the present invention with the plasma display according to the first preferred embodiment of the present invention, first substrates of the two embodiments are identical in structure whereas second substrates of the two embodiments are different. Accordingly, the same reference numeral of 11 will be used for the first substrate in the description that follows, while reference numeral 42 will be used for the second substrate.

The plasma display according to the eighth preferred embodiment of the present invention, with reference to FIGS. 36 through 38, includes the first and second substrates 11 and 42 made of glass provided opposing one another. A plurality of first electrodes 14 (scanning electrodes and sustain electrodes) are formed on an inside surface of the first substrate 11, and a first dielectric layer 13, which includes a protection layer 13*a* made of a compound such as MgO, is formed covering the first electrodes 14.

With respect to the second substrate 42, a plurality of stripe-type main barrier ribs 44 are integrally formed on the second substrate 42 protruding from a surface of the same that opposes the first substrate 11. A plurality of discharge cells 46 are defined by the formation of the main barrier ribs 44. Also, a plurality of electrode barrier ribs 48 are formed between the main barrier ribs 44 and in the same manner as the main barrier ribs 44. Formed on a distal end of each of the electrode barrier ribs 48 is a second electrode (address electrode) 50 and a second dielectric layer 52, in this sequence, and formed on a distal end of each of the main barrier ribs 44 is one of the second electrodes 50 and a third dielectric layer 52'.

With the above structure, the main barrier ribs 44, the discharge cells 46, the electrode barrier ribs 48, the second electrodes 50, and the second and third dielectric layers 52 and 52' are all formed in the same direction, that is, in parallel. The first electrodes 14 of the first substrate 11 are formed perpendicular to the elements of the second substrate 42. Further, the electrode barrier ribs 48 are provided at substantially a center between a pair of main barrier ribs 44 (i.e., a center of a width of the discharge cells 46), and an upper end of the electrode barrier ribs 48 is substantially the same height as an upper end of the main barrier ribs 44. Further, the second electrodes 50 are formed along the upper ends of the electrode barrier ribs 48 and the main barrier ribs 44, and the second and third dielectric layers 52 and 52' are formed covering the second electrodes 50 respectively of the electrode barrier ribs 48 and the main barrier ribs 44.

Among the second electrodes 50, only the second electrodes formed on the end of the electrode barrier ribs 48 receive power to perform discharge with the first electrodes 14 of the first substrate 11. The second electrodes 50 formed on the ends of the main barrier ribs 44 are provided so that gaps (corresponding to a thickness of the second electrodes 50) are not formed between the main barrier ribs 44 and the protection layer 13*a* of the first substrate 11 when the first substrate 11 is assembled to the second substrate 42.

Each electrode lattice wall 48 divides each discharge cell 46 formed between the main barrier ribs 44 into a plurality of partitioned discharge cells. That is, each discharge cell 46 is divided equally into two partitioned discharge cells 46A and 46B, which are concave-shaped as shown in FIGS. 36 and 37. The partitioned discharge cells 46A and 46B are used as spaces in which gas discharge is performed. R, G, B (red, green, blue) phosphor layers 54 are formed on a bottom surface of the partitioned discharge cells 46A and 46B.

Either a red, green, or blue phosphor layer 54 is formed in one discharge cell 46. However, with the formation of the electrode barrier ribs 48 between the main barrier ribs 44, the phosphor layers 54 formed in each pair of the partitioned discharge cells 46A and 46B are of the same color. In FIGS. 36, 37, 38, the phosphor layers 54 of a red color are denoted by 54(R), the phosphor layers 54 of a green color are denoted by 54(G), and the phosphor layers 54 of a blue color are denoted by 54(B).

In the plasma display according to the eighth preferred embodiment, a width and depth of the partitioned discharge cells 46A and 46B are formed corresponding to a brightness of the phosphor layers 54 formed therein such that, in effect, an area of the phosphor layers 54 is controlled according to a brightness of the different phosphor layers 54.

For example, in order to display a white color of a 9,300K color temperature, it is necessary to establish brightness ratios between red and green, and between green and blue at 1.39 and 3.35, respectively. However, since brightness ratios of actual phosphor materials varies according to the materials used, the areas of the phosphor layers 54 according to color such that these ratios can be achieved is determined, then the widths and depths of the partitioned discharge cells 46A and 46B are formed accordingly.

In the case where areas of the phosphor layers 54 are the same and input signal levels are the same, and phosphor materials are used such that the brightness ratio between red and blue is 2.49 and between green and blue is 5.08, in order to obtain a brightness ratio of 1.39 between red and blue and 3.35 between green and blue, a ratio between areas of the red phosphor layer 54(R), green phosphor layer 54(G), and blue phosphor layer 54(B) is 56:66:100.

That is, in the eighth preferred embodiment, the widths and depths of the partitioned discharge cells 46A and 46B are made increasingly larger according to whether they are housing the red phosphor layers 54(R), the green phosphor layer 54(G), or the blue phosphor layer 54(B), in this order. With this configuration, white, which has a high color temperature as described above, is able to be displayed.

A method will now be described in which the partitioned discharge cells 46A and 46B having predetermined widths and depths are easily formed, and the main barrier ribs 44 and the electrode barrier ribs 48 are integrally formed to the second substrate 42.

First, applied to an upper surface of one of two flat glass substrates is a sheet-type photoresist such as a dry film resist (DFR), which is resistant to sandblasting. Next, the photoresist is exposed and developed using a mask such that photoresists are formed in a predetermined pattern that correspond to locations and an upper-surface shape of the main barrier ribs 44 and the electrode barrier ribs 48.

Subsequently, areas where the photoresists of the glass substrate are not formed are removed to a predetermined depth and shaped by a sandblast process, in which an abrasive such as glass beads having a particle diameter of 20–30 $\mu$m or calcium carbonate is used, such that the main barrier ribs 44 and the electrode barrier ribs 48 are formed. The photoresists are peeled away following this process. As a result, the partitioned discharge cells 46A and 46B are formed between the main barrier ribs 44 and the electrode barrier ribs 48. That is, each of the discharge cells 46 formed between the main barrier ribs 44 are divided by the formation of the electrode barrier ribs 48 to form a pair of the partitioned discharge cells 46A and 46B for each electrode lattice wall 48.

Accordingly, the main barrier ribs 44 and electrode barrier ribs 48 are easily formed integrally to the flat glass substrate using a sandblast process. Further, with the used of sandblasting, the widths and depths of the partitioned discharge cells 46A and 46B can be easily controlled to desired dimensions, and the partitioned discharge cells 46A and 46B can be easily formed into their concave shape.

Referring to FIG. 39, the relation between areas of the phosphor layers 54 and the main and dimensions of the partitioned discharge cells 46A and 46B, and adjustments made in both the widths and depths, or only the widths, of the partitioned discharge cells 46A and 46B will now be described. Only the partitioned discharge cells 46A and 46B and the corresponding phosphor layers 54 have been extracted in FIG. 39 to simplify the explanation.

The partitioned discharge cells 46A and 46B of a pair including one of the discharge cells 46 are formed identically such that the areas of the phosphor layers 54 in each pair of the partitioned discharge cells 46 are the same. Also, the phosphor layers 54 of the same color are provided in each such pair. To simplify the explanation, therefore, only the partitioned discharge cell 46A (for each color) will be described. The terms red partitioned discharge cell, green partitioned discharge cell, and blue partitioned discharge cell will be used for further clarification.

With use of the sandblasting process as described above, the partitioned discharge cell 46A results in a semi-circular cross-sectional shape. If a width of the red partitioned discharge cell 46A is X, a depth of the red partitioned discharge cell 46A is X/2, a width of the green partitioned discharge cell 46A is X+I, and a width of the blue partitioned discharge cell 46A is X+I+J, then a depth of the green partitioned discharge cell 46A is X/2+I, and a depth of the blue partitioned discharge cell 46A is X/2+I+J.

If it is assumed that the phosphor layers 54 are formed over the entire surface areas of the partitioned discharge cells 46A, if a length in a lengthwise direction of the partitioned discharge cells 46 is Y, and areas of the phosphor layers 54 formed in the red, green, and blue partitioned discharge cells 46A are SR, SG, and SB, respectively, $SR=XY\pi/2$, $SG=(X+I)Y\pi/2$, and $SB=(X+I+J)Y\pi/2$.

That is, the widths and depths of the partitioned discharge cells 46A may be established based on the ratios of the areas for the phosphor layers 54 determined from the brightness ratios of the phosphor layers 54 that are used, and the above numerical relations.

In the case of a discharge cell with the width X and not having a concave portion of the length Y, the area S of the phosphor layers when the width of the discharge cell is increased by I is (X+I)Y.

Accordingly, with respect to the red partitioned discharge cell 46A, a ratio of the area SG of a phosphor layer in which the width and length have been increased by I and of the area S of a phosphor layer having the same width as the red partitioned discharge cell 46A but increased by I and not having a concave portion become $\{(X+I)Y\pi/2\}/\{(X+I)Y\}=\pi/2$, that is, roughly 3/2.

That is, in order to obtain the same area of the phosphor layers 54, the width of the partitioned discharge cell 46A in which both width and depth are increased by sandblasting and a width of the partitioned discharge cell 46A in which only the width is increased is roughly at a ratio of 2/3.

Accordingly, since, with the use of sandblasting, widths and depths of the partitioned discharge cells 46A and 46B for phosphor layers 54 that require an increase in area may be increased, the widths of the partitioned discharge cells 46A and 46B can be made smaller than when only increasing the widths of the same. Therefore, the difference in surface areas between the discharge cells 46 for the different colors and the first electrodes 14 (scanning electrodes and sustain electrodes) of the first substrate 11 is minimized such that a difference in driving voltages for the discharge cells 46 for the different colors is reduced.

In the eighth preferred embodiment of the present invention, each of the discharge cells 46 are divided into two partitioned discharge cells 46A and 46B by the electrode barrier ribs 48, the second electrodes 50 and the second dielectric layers 52 are formed on the ends of the electrode barrier ribs 48, only the phosphor layers 54 are formed within the partitioned discharge cells 46A is and 46B, and widths and depths of the partitioned discharge cells 46A and 46B are varied according to color and corresponding to the brightness of the phosphor layers 54 such that the areas of the phosphor layers 54 in the partitioned discharge cells 46A and 46B are established according to the brightness of the phosphor layers 54.

That is, in the prior art, brightness ratios of light emitted from each discharge cell are made to correspond to established brightness ratios by adjusting signal input levels. In the eighth preferred embodiment of the present invention, on the other hand, the widths and depths of the partitioned discharge cells 46A and 46B are adjusted to control the areas of the phosphor layers 54 such that the brightness ratios of the light emitted from the discharge cells 46 are made to conform to established brightness ratios without having to reduce the input signal levels. As a result, the plasma display obtains high resolution pictures, the clear display of white, and the prevention of a reduction in the display of gray levels.

Further, in the case of forming the electrodes to the innermost portion of the discharge cells as in the prior art, there is the concern in the change in the surface area of the electrodes formed on the second substrate (address electrodes) by changing the width of the discharge cells. As a result, the discharge area varies for each displayed color such that discharge characteristics change, and discharge driving becomes difficult. However, in the eight preferred embodiment of the present invention, the electrode barrier ribs 48 are provided in the discharge cells 46, the second electrodes (address electrodes) 50 and the second dielectric layers 52 are formed on the upper end of the electrode barrier ribs, and only the phosphor layers 54 are formed within the partitioned discharge cells 46A and 46B. Accordingly, even with changes in the width of the partitioned discharge cells 46A and 46B, the widths of the second electrodes 50 are kept equal so no interference is given to discharge driving.

Further, as described above with regards to the eighth preferred embodiment of the present invention, either both the widths and depths of the partitioned discharge cells 46A and 46B may be adjusted according to the color displayed from the same, or only the widths of the partitioned discharge cells 46A and 46B may be adjusted according to the color displayed from the same. However, since the widths of the partitioned discharge cells 46A and 46B can be made smaller when adjusting both the widths and depths of the same, it is preferable to perform adjustment to both these dimensions. With the decrease in the widths of the partitioned discharge cells 46A and 46B, the difference in surface areas between the discharge cells 46 for the different colors and the first electrodes 14 (scanning electrodes and sustain electrodes) of the first substrate 11 is minimized such that a difference in driving voltages for the discharge cells 46 for the different colors is reduced.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display, comprising:

first and second substrates opposing one another;

a plurality of first electrodes formed on a surface of the first substrate facing the second substrate;

a first dielectric layer covering the first electrodes;

a plurality of main barrier ribs integrally formed on a surface of the second substrate facing the first substrate, the main barrier ribs defining a plurality of discharge cells;

a plurality of electrode barrier ribs formed on the second substrate between the main barrier ribs;

a second electrode and a second dielectric layer being formed on a distal end of each of the electrode barrier ribs, with no materials for electrode or dielectric layers provided to innermost portions between the barrier ribs of said main barrier ribs and said electrode barrier ribs;

phosphor layers formed within the discharge cells; and discharge gas provided in the discharge cells.

2. The plasma display of claim 1, with the second dielectric layer being formed on the second electrode formed on the distal end of each of the electrode barrier ribs.

3. The plasma display of claim 1, further comprising a third dielectric layer being formed on a distal end of each of the main barrier ribs, and a height of an upper surface of the third dielectric layer and a height of an upper surface of the second dielectric layer being substantially the same.

4. The plasma display of claim 3, further comprised of said second electrodes formed on said electrode barrier ribs realizing an electrical connection with said first electrodes formed on said first substrate accommodating discharge in areas between said second electrodes and said first electrodes, and said second electrodes formed on said main barrier ribs used to accommodate the height of said third dielectric layers of said main barrier ribs being substantially the same as a height of said second dielectric layers of said electrode barrier ribs, said second electrodes of said main barrier ribs not being electrically connected and acting as floating electrodes, or grounded to not affect the discharge operation.

5. The plasma display of claim 1, wherein the electrode barrier ribs are formed integrally with the second substrate.

6. The plasma display of claim 1 wherein each discharge cell is divided into a plurality of partitioned discharge cells in which the same phosphor layer is formed.

7. The plasma display of claim 6, wherein each discharge cell is divided into two partitioned discharge cells.

8. The plasma display of claim 6, wherein the partitioned discharge cells defined by the main barrier ribs include concave surfaces, and a width of each of the partitioned discharge cells are formed to correspond to a color displayed by the particular partitioned discharge cell.

9. The plasma display of claim 8, wherein the partitioned discharge cells displaying blue include a larger width than the partitioned discharge cells displaying green, and the partitioned discharge cells displaying green have a larger width than the partitioned discharge cells displaying red.

10. A method for manufacturing the plasma display of claim 1, comprising:

integrally forming the plurality of main barrier ribs on the second substrate being a plasma display substrate, the main barrier ribs defining the plurality of discharge cells;

forming the electrode barrier ribs between the main barrier ribs;

forming the second electrode on the distal end of each of the electrode barrier ribs; and forming the dielectric layer on each of the electrodes.

11. The method of claim 10, wherein the main barrier ribs and the electrode barrier ribs are formed simultaneously.

12. The method of claim 10, wherein the main barrier ribs, the electrode barrier ribs, and the electrodes are formed simultaneously.

13. The method of claim 10, wherein the main barrier ribs, the electrode barrier ribs, the electrodes, and the dielectric layers are formed simultaneously.

14. The method of claim 10, with the main barrier ribs and electrode barrier ribs being formed by using the second electrodes as a mask.

15. The method of claim 10, with the second electrode forming before the main barrier ribs.

16. The method of claim 10, with the main barrier ribs being integrally formed to the second substrate before the formation of the second electrode and second dielectric layer.

17. The plasma display of claim 1, further comprised of the widths and heights of discharge cells being adjusted according to the color displayed, the widths and depths of the partitioned discharge cells are adjusted to control the areas of the phosphor layers to accommodate the brightness ratios of the light emitted from the discharge cells being made to conform to established brightness ratios without reducing the input signal levels.

18. A plasma display, comprising:

first and second substrates opposing one another;

a plurality of first electrodes formed on a surface of the first substrate facing the second substrate;

a first dielectric layer covering the first electrodes;

a plurality of main barrier ribs integrally formed on a surface of the second substrate facing the first substrate, the main barrier ribs defining a plurality of discharge cells;

a plurality of electrode barrier ribs formed on the second substrate between the main barrier ribs;

a second electrode and a second dielectric layer being formed on a distal end of each of the electrode barrier ribs;

phosphor layers formed within the discharge cells;

discharge gas provided in the discharge cells; and a third dielectric layer being formed on a distal end of each of the main barrier ribs, and a height of an upper surface of the third dielectric layer being greater than a height of an upper surface of the second dielectric layer.

19. The plasma display of claim 1, wherein one of the second electrodes is formed on a distal end of each of the main barrier ribs and the electrode barrier ribs.

20. A plasma display, comprising:

a first substrate;

a second substrate opposing the first substrate;

a plurality of first electrodes formed on a surface of the first substrate facing the second substrate;

a first dielectric layer covering the first electrodes;

a plurality of main lattice walls integrally formed on a surface of the second substrate facing the first substrate, the main lattice walls defining a plurality of discharge cells;

a plurality of electrode lattice walls integrally formed on the second substrate between the main lattice walls, each electrode lattice walls dividing each discharge cell formed between the main lattice walls into a plurality of partitioned discharge cells, the partitioned discharge cells for each of the discharged cells accommodating a phosphor layer of the same color;

a second electrode formed on a distal end of each of the electrode lattice walls; and a second dielectric layer formed on the second electrode formed on the distal end of each of the electrode lattice walls, with electrode and dielectric layers being formed on only the distal ends of the lattice walls.

21. The plasma display of claim 20, further comprising a third dielectric layer being formed on a distal end of each of the main lattice walls, and a height of an upper surface of the third dielectric layer and a height of an upper surface of the second dielectric layer being substantially the same.

22. A plasma display, comprising:

a first substrate;

a second substrate opposing the first substrate;

a plurality of first electrodes formed on a surface of the first substrate facing the second substrate;

a first dielectric layer covering the first electrodes;

a plurality of main lattice walls integrally formed on a surface of the second substrate facing the first substrate, the main lattice walls defining a plurality of discharge cells;

a plurality of electrode lattice walls integrally formed on the second substrate between the main lattice walls, each electrode lattice walls dividing each discharge cell formed between the main lattice walls into a plurality of partitioned discharge cells, the partitioned discharge cells for each of the discharged cells accommodating a phosphor layer of the same color;

a second electrode formed on a distal end of each of the electrode lattice walls; and a second dielectric layer formed on the second electrode formed on the distal end of each of the electrode lattice walls; and a third dielectric layer being formed on a distal end of each of the main lattice walls, and a height of an upper surface of the third dielectric layer being greater than a height of an upper surface of the second dielectric layer.

* * * * *